US009675179B2

(12) United States Patent
Walker

(10) Patent No.: US 9,675,179 B2
(45) **Date of Patent: *Jun. 13, 2017**

(54) ACTIVE RESPONSE SEATING SYSTEM

(71) Applicant: TRAC TEC, LTD., Okemos, MI (US)

(72) Inventor: Brock Walker, Okemos, MI (US)

(73) Assignee: Trac Tec, Ltd., Okemos, MI (US)

( * ) Notice: Subject to any disclaimer, the term of this patent is extended or adjusted under 35 U.S.C. 154(b) by 10 days.

This patent is subject to a terminal disclaimer.

(21) Appl. No.: 14/707,571

(22) Filed: May 8, 2015

(65) Prior Publication Data

US 2015/0313366 A1 Nov. 5, 2015

Related U.S. Application Data

(63) Continuation of application No. 13/768,990, filed on Feb. 15, 2013, now Pat. No. 9,049,937, which is a continuation of application No. 12/444,455, filed as application No. PCT/US2007/021437 on Oct. 5, 2007, now Pat. No. 8,398,170.

(60) Provisional application No. 60/849,762, filed on Oct. 6, 2006.

(51) Int. Cl.

| | |
|---|---|
| ***A47C 7/02*** | (2006.01) |
| ***A47C 7/46*** | (2006.01) |
| ***A47C 7/40*** | (2006.01) |

(52) U.S. Cl.

CPC ..... *A47C 7/46* (2013.01); *A47C 7/022* (2013.01); *A47C 7/40* (2013.01)

(58) Field of Classification Search

CPC ..... A47C 7/46; A47C 7/022; A47C 7/40
USPC ..... 297/284.1, 284.3–284.9, 452.28, 452.29, 297/452.35, 452.37, 230.14
See application file for complete search history.

(56) References Cited

U.S. PATENT DOCUMENTS

| | | | |
|---|---|---|---|
| 1,510,187 | A | 9/1924 | Martin |
| 1,667,626 | A | 4/1928 | Epstein |
| 1,716,871 | A | 6/1929 | Weldon |
| 2,139,028 | A | 12/1938 | Mensendicck et al. |
| 2,219,475 | A | 10/1940 | Flaherty |
| 2,255,464 | A | 9/1941 | Hall, Jr. |

(Continued)

FOREIGN PATENT DOCUMENTS

| | | |
|---|---|---|
| DE | 3334864 | 4/1985 |
| DE | G9317020.3 | 3/1994 |

(Continued)

OTHER PUBLICATIONS

Supplementary European Search Report completed Apr. 16, 2013 for EP07839308.

(Continued)

*Primary Examiner* — Laurie K Cranmer
(74) *Attorney, Agent, or Firm* — Brinks Gilson & Lione

(57) ABSTRACT

Novel Seats having a plurality of defined zones for supporting the human anatomy are disclosed. Seats including one or more recoil shields and/or inserts to assist in supporting or isolating certain desired portions of the human anatomy, as well as seats including both seat back structures and seat pan structures, with one or both including zoned configurations designed to support and stabilize specific structures of the human anatomy in a defined manner are also disclosed. The novel seats are useful, inter alia, for individually supporting certain anatomical areas and provide seat zones that collectively support, cradle and permit the human anatomy to be supported in a comfortable manner.

33 Claims, 14 Drawing Sheets

(56) References Cited

U.S. PATENT DOCUMENTS

| | | | |
|---|---|---|---|
| 2,554,337 | A | 5/1951 | Lampert |
| 2,663,359 | A | 12/1953 | Wood |
| 2,756,808 | A | 7/1956 | Eichorst |
| 2,769,485 | A | 11/1956 | Shapiro |
| 2,831,533 | A | 4/1958 | Pasquarelli |
| 2,847,061 | A | 8/1958 | Morton |
| 2,855,986 | A | 10/1958 | Engelen, Sr. |
| 3,024,784 | A | 3/1962 | Monfardini |
| 3,081,129 | A | 3/1963 | Ridder |
| 3,112,137 | A | 11/1963 | Drenth |
| 3,138,404 | A | 6/1964 | Newton |
| 3,145,054 | A | 8/1964 | Sopko, Jr. |
| 3,189,917 | A | 6/1965 | Sims |
| 3,288,525 | A | 11/1966 | Cerf |
| 3,348,880 | A | 10/1967 | Swann |
| 3,362,402 | A | 1/1968 | Loeffel et al. |
| 3,497,872 | A | 3/1970 | Mitchell |
| 3,501,197 | A | 3/1970 | Burton |
| 3,512,835 | A | 5/1970 | Flototto |
| 3,540,776 | A | 11/1970 | Wilson |
| 3,568,670 | A | 3/1971 | Gaylord, Jr. |
| 3,642,319 | A | 2/1972 | Berchicci |
| 3,657,739 | A | 4/1972 | Holmes, Sr. |
| 3,713,657 | A | 1/1973 | Presta |
| 3,717,143 | A | 2/1973 | Johnson |
| 3,720,441 | A | 3/1973 | Corchran |
| 3,740,096 | A | 6/1973 | Bridger |
| 3,807,794 | A | 4/1974 | Beyer |
| 3,855,631 | A | 12/1974 | Ettinger |
| 3,900,896 | A | 8/1975 | Ackerman |
| 3,904,242 | A | 9/1975 | Koepke et al. |
| 3,926,183 | A | 12/1975 | Spiro |
| 3,927,665 | A | 12/1975 | Wax |
| 3,964,474 | A | 6/1976 | Fox |
| 3,982,786 | A | 9/1976 | Burgin et al. |
| 4,017,118 | A | 4/1977 | Cawley |
| 4,034,747 | A | 7/1977 | Leroy |
| 4,078,842 | A | 3/1978 | Zur |
| 4,099,524 | A | 7/1978 | Cueman et al. |
| 4,156,544 | A | 5/1979 | Swenson et al. |
| 4,175,553 | A | 11/1979 | Rosenberg |
| 4,182,533 | A | 1/1980 | Arndt et al. |
| 4,219,193 | A | 8/1980 | Newman |
| 4,295,681 | A | 10/1981 | Gregory |
| 4,313,637 | A | 2/1982 | Barley |
| 4,338,685 | A | 7/1982 | LaPorta, Jr. |
| 4,437,702 | A | 3/1984 | Agosta |
| 4,471,993 | A | 9/1984 | Watson |
| 4,475,543 | A | 10/1984 | Brooks et al. |
| 4,489,982 | A | 12/1984 | Morrow |
| D277,316 | S | 1/1985 | Meares |
| 4,501,023 | A | 2/1985 | Bilberry |
| 4,502,728 | A | 3/1985 | Sheldon et al. |
| 4,516,568 | A | 5/1985 | Baxter et al. |
| 4,522,447 | A | 6/1985 | Snyder et al. |
| 4,535,495 | A | 8/1985 | Oldfield |
| 4,556,254 | A | 12/1985 | Roberts |
| 4,559,933 | A | 12/1985 | Batard et al. |
| 4,564,235 | A | 1/1986 | Hatsutta et al. |
| 4,572,578 | A | 2/1986 | Perkins |
| 4,576,154 | A | 3/1986 | Hyman et al. |
| 4,597,386 | A | 7/1986 | Goldstein |
| 4,634,176 | A | 1/1987 | Scott |
| 4,638,510 | A | 1/1987 | Hubbard |
| 4,643,174 | A | 2/1987 | Horiuchi |
| 4,715,362 | A | 12/1987 | Scott |
| 4,718,724 | A | 1/1988 | Quinton et al. |
| 4,752,067 | A | 6/1988 | Colonello |
| 4,753,478 | A | 6/1988 | Weinreich |
| D296,930 | S | 7/1988 | Carabelli |
| 4,757,554 | A | 7/1988 | Blair |
| 4,789,202 | A | 12/1988 | Alter |
| 4,821,339 | A | 4/1989 | Fair |
| 4,824,169 | A | 4/1989 | Jarrell |
| 4,835,801 | A | 6/1989 | Walpin et al. |
| 4,836,194 | A | 6/1989 | Sebastian et al. |
| 4,854,306 | A | 8/1989 | Pujals, Jr. |
| 4,862,536 | A | 9/1989 | Pruit |
| 4,870,705 | A | 10/1989 | Higby et al. |
| 4,876,755 | A | 10/1989 | Parrish |
| 4,881,529 | A | 11/1989 | Santos |
| 4,883,320 | A | 11/1989 | Izumida et al. |
| 4,890,235 | A | 12/1989 | Reger et al. |
| 4,926,845 | A | 5/1990 | Harris |
| 4,930,499 | A | 6/1990 | Rowe |
| 4,944,554 | A | 7/1990 | Gross et al. |
| 4,969,684 | A | 11/1990 | Zarotti |
| 4,981,325 | A | 1/1991 | Zacharkow |
| 4,996,720 | A | 3/1991 | Fair |
| 5,054,854 | A | 10/1991 | Pruit |
| D321,760 | S | 11/1991 | Carney |
| D325,087 | S | 3/1992 | Brinker |
| 5,105,806 | A | 4/1992 | Woodhouse et al. |
| 5,114,209 | A | 5/1992 | Dunn |
| 5,188,585 | A | 2/1993 | Peters |
| 5,190,347 | A | 3/1993 | Shiow-Lan |
| 5,201,761 | A | 4/1993 | Serola |
| 5,240,308 | A | 8/1993 | Goldstein et al. |
| 5,314,235 | A | 5/1994 | Johnson |
| 5,320,409 | A | 6/1994 | Katoh et al. |
| 5,328,245 | A | 7/1994 | Marks et al. |
| 5,335,965 | A | 8/1994 | Sessini |
| 5,397,164 | A | 3/1995 | Schuster et al. |
| 5,452,728 | A | 9/1995 | Iams |
| 5,452,940 | A | 9/1995 | Maier |
| 5,505,520 | A | 4/1996 | Frusti et al. |
| 5,518,294 | A | 5/1996 | Ligon, Sr. et al. |
| 5,520,624 | A | 5/1996 | Amato |
| 5,547,251 | A | 8/1996 | Axelson |
| 5,556,169 | A | 9/1996 | Parrish et al. |
| 5,567,010 | A | 10/1996 | Sparks |
| 5,567,011 | A | 10/1996 | Sessini |
| 5,577,811 | A | 11/1996 | Ogg |
| 5,586,561 | A | 12/1996 | Archer, III |
| 5,587,933 | A | 12/1996 | Gross |
| 5,588,703 | A | 12/1996 | Itou |
| 5,626,616 | A | 5/1997 | Speece |
| 5,657,499 | A | 8/1997 | Vaughn et al. |
| 5,678,891 | A | 10/1997 | O'Neill et al. |
| 5,695,245 | A | 12/1997 | Carlson et al. |
| 5,704,687 | A | 1/1998 | Klingler |
| 5,713,631 | A | 2/1998 | O'Neill et al. |
| 5,718,476 | A | 2/1998 | De Pascal et al. |
| 5,762,397 | A | 6/1998 | Venuto et al. |
| 5,823,620 | A | 10/1998 | Le Caz |
| 5,833,319 | A | 11/1998 | Davis |
| 5,868,463 | A | 2/1999 | MacKenzie et al. |
| 5,868,466 | A | 2/1999 | Massara et al. |
| 5,975,629 | A | 11/1999 | Lorbiecki |
| 6,033,025 | A | 3/2000 | Christofferson et al. |
| 6,041,457 | A | 3/2000 | Summers |
| 6,059,370 | A | 5/2000 | Kanyer et al. |
| 6,088,643 | A | 7/2000 | Long et al. |
| 6,092,249 | A | 7/2000 | Kamen et al. |
| 6,092,871 | A | 7/2000 | Beaulieu |
| 6,098,000 | A | 8/2000 | Long et al. |
| 6,125,851 | A | 10/2000 | Walker et al. |
| 6,129,419 | A | 10/2000 | Neale |
| 6,206,463 | B1 | 3/2001 | Whingham |
| 6,257,664 | B1 | 7/2001 | Chew et al. |
| 6,334,651 | B1 | 1/2002 | Duan et al. |
| 6,497,454 | B1 | 12/2002 | Davidsson |
| 6,532,962 | B1 | 3/2003 | Walker et al. |
| 6,543,844 | B1 | 4/2003 | Ryan et al. |
| 6,578,916 | B2 | 6/2003 | Longhi et al. |
| 6,619,739 | B2 | 9/2003 | McMillen |
| 6,652,029 | B2 | 11/2003 | McMillen |
| 6,676,215 | B1 | 1/2004 | Shah et al. |
| 6,695,402 | B2 | 2/2004 | Sloan, Jr. |
| 6,824,214 | B2 | 11/2004 | McMillen |
| 6,969,114 | B2 | 11/2005 | Keilhauer |
| 7,093,898 | B2 | 8/2006 | Ladron De Guevara |
| 7,140,057 | B2 | 11/2006 | Hetzel et al. |
| 7,152,920 | B2 | 12/2006 | Sugiyama et al. |

(56) References Cited

U.S. PATENT DOCUMENTS

| | | | |
|---|---|---|---|
| 7,273,252 | B2 | 9/2007 | Iijima et al. |
| 7,322,651 | B2 | 1/2008 | Makhsous et al. |
| 7,429,080 | B2 | 9/2008 | Walker et al. |
| 7,445,008 | B1 | 11/2008 | Walker |
| 7,537,286 | B2 | 5/2009 | Walker et al. |
| 7,909,402 | B2 | 3/2011 | Chu et al. |
| 7,931,334 | B1 | 4/2011 | Caruso |
| 8,011,044 | B1 | 9/2011 | Jones |
| 2002/0008417 | A1 | 1/2002 | Holst et al. |
| 2002/0109383 | A1 | 8/2002 | Klingler |
| 2002/0175553 | A1 | 11/2002 | Steifensand |
| 2003/0197407 | A1 | 10/2003 | Sanchez |
| 2004/0075320 | A1 | 4/2004 | Klingler |
| 2005/0104428 | A1 | 5/2005 | Walker et al. |
| 2006/0001304 | A1 | 1/2006 | Walker et al. |

FOREIGN PATENT DOCUMENTS

| | | |
|---|---|---|
| DE | 29922030 | 7/2000 |
| DE | 10114521 | 9/2002 |
| EP | 0423079 | 10/1990 |
| EP | 0700653 | 3/1996 |
| JP | 03029610 | 4/1991 |
| JP | 08191734 | 7/1996 |
| JP | 2002360375 | 12/2002 |
| WO | 92/14387 | 9/1992 |
| WO | WO 01/56428 | 8/2001 |
| WO | 02/28339 | 4/2002 |
| WO | WO 2004/026623 | 4/2004 |
| WO | WO 2004/089693 | 10/2004 |

OTHER PUBLICATIONS

International Search Report mailed Feb. 27, 2008 for PCT/US2007/021437 filed Oct. 5, 2007.

International Preliminary Report on Patentability issued Apr. 7, 2009 for PCT/US2007/021437 filed Oct. 5, 2007.

Written Opinion of the International Searching Authority mailed Feb. 27, 2008 for PCT/US2007/021437 filed Oct. 5, 2007.

European Communication Pursuant to Article 94(3) in European Application No. 07 839 308.9 dated Jun. 13, 2014.

1000

1100

ACTIVE RESPONSE SEATING SYSTEM

CROSS-REFERENCE TO CO-PENDING APPLICATIONS

The present application is a continuation of U.S. patent application Ser. No. 13/768,990, filed Feb. 15, 2013, now allowed, which is a continuation of U.S. Pat. No. 8,398,170, issued on Mar. 19, 2013, which is a National Stage Entry of PCT/US2007/021437, filed Oct. 5, 2007, which claims priority of U.S. Provisional Application Ser. No. 60/849,762, filed Oct. 6, 2006. Each of these applications is hereby incorporated herein by reference in its entirety.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to medically engineered support surfaces that can form the basis of support for the human anatomy in seats, beds, and any other environment where the anatomy needs to be supported.

DESCRIPTION OF PRESENTLY PREFERRED EXAMPLES OF THE INVENTION BRIEF DESCRIPTION OF FIGURES

The invention is better understood by reading the following detailed description with reference to the accompanying drawings in which.

Figure 7:
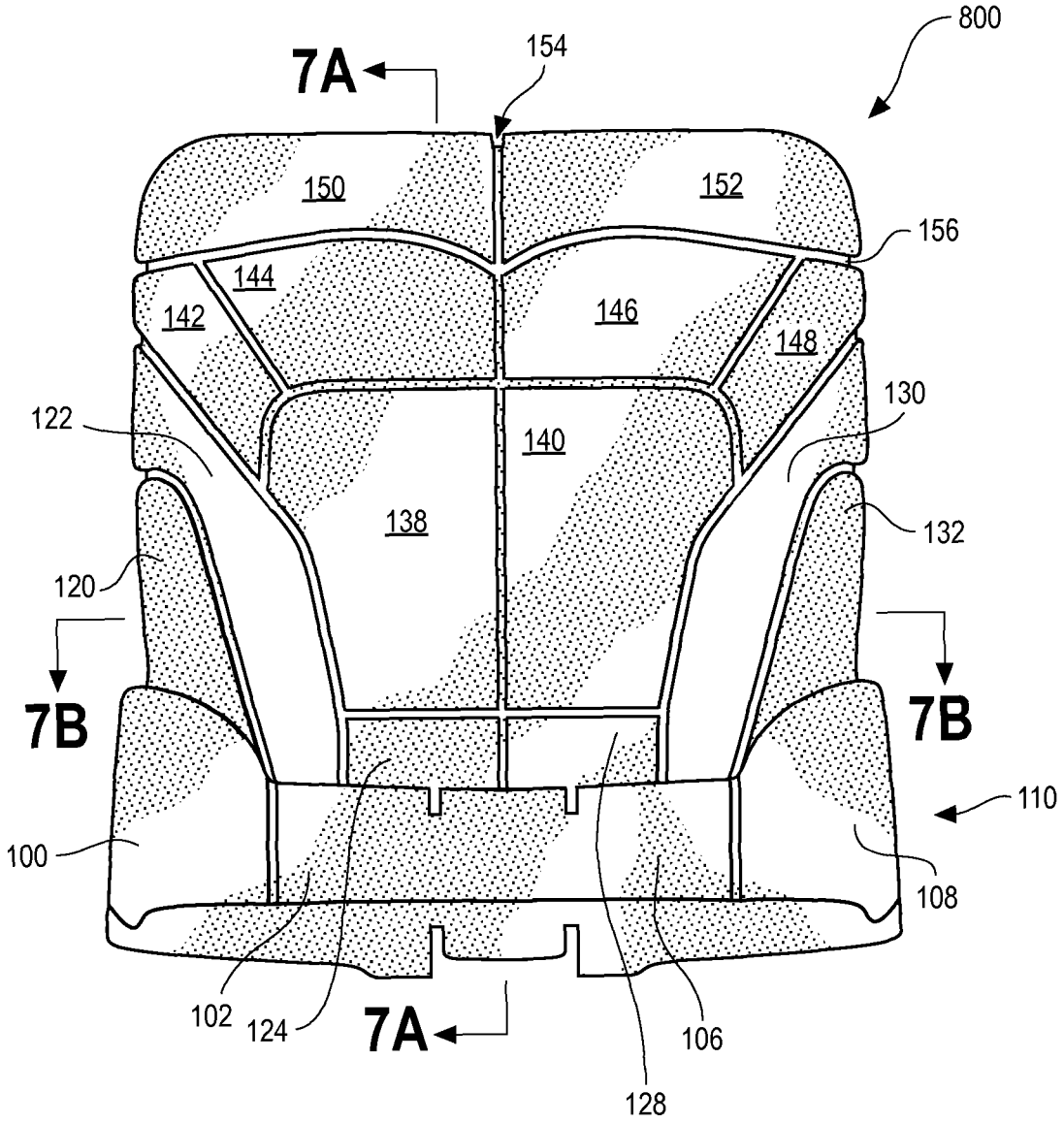
FIG. 7 is a front perspective of a molded seat formed with multi-zoned sections.
Figure 7A:
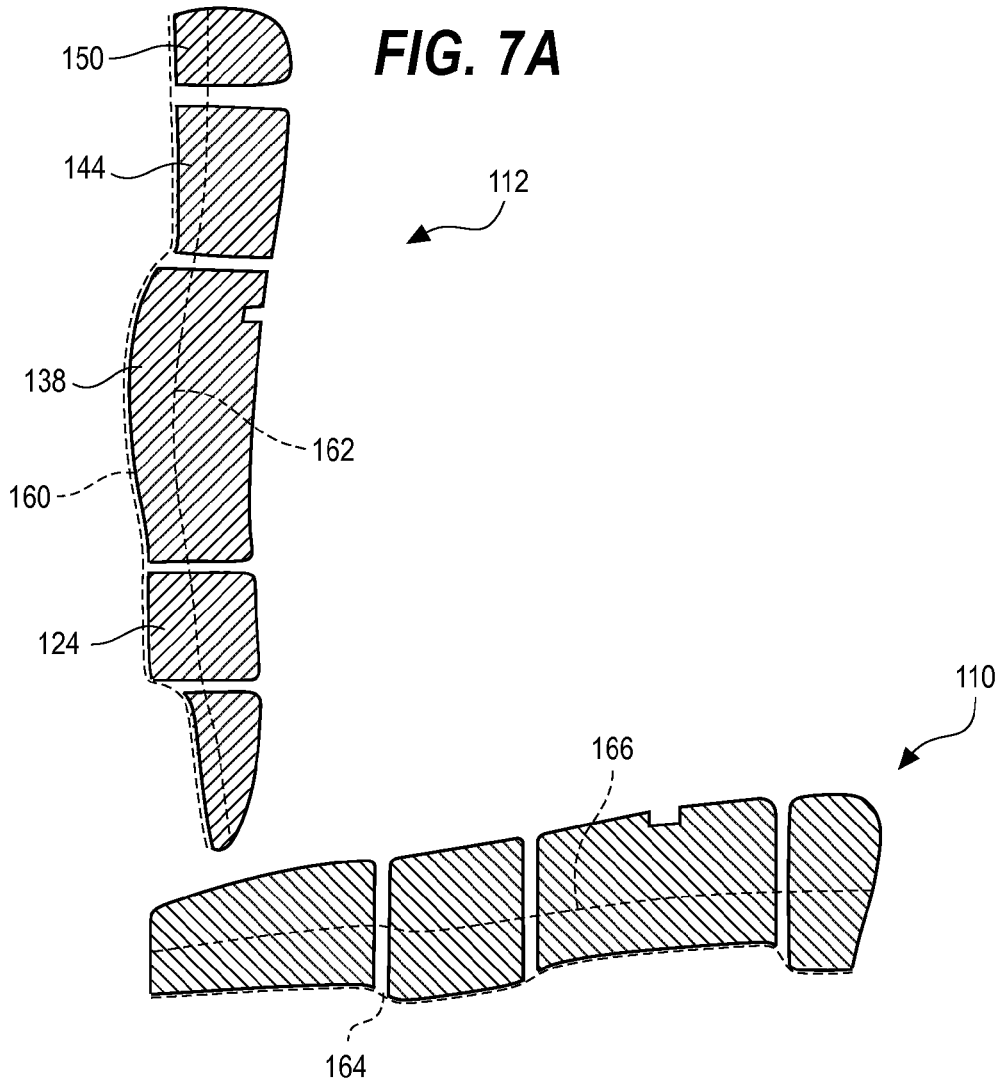
Figure 7B:
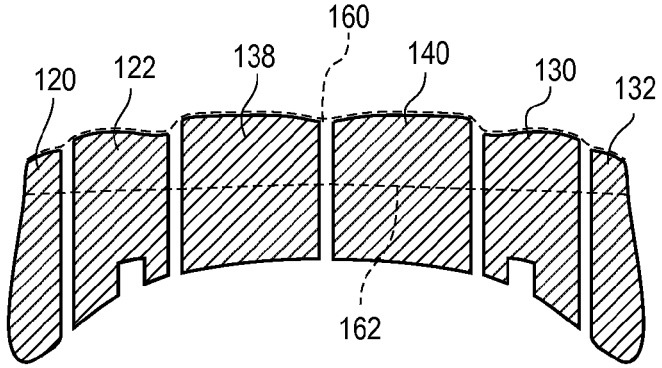
Figure 8:
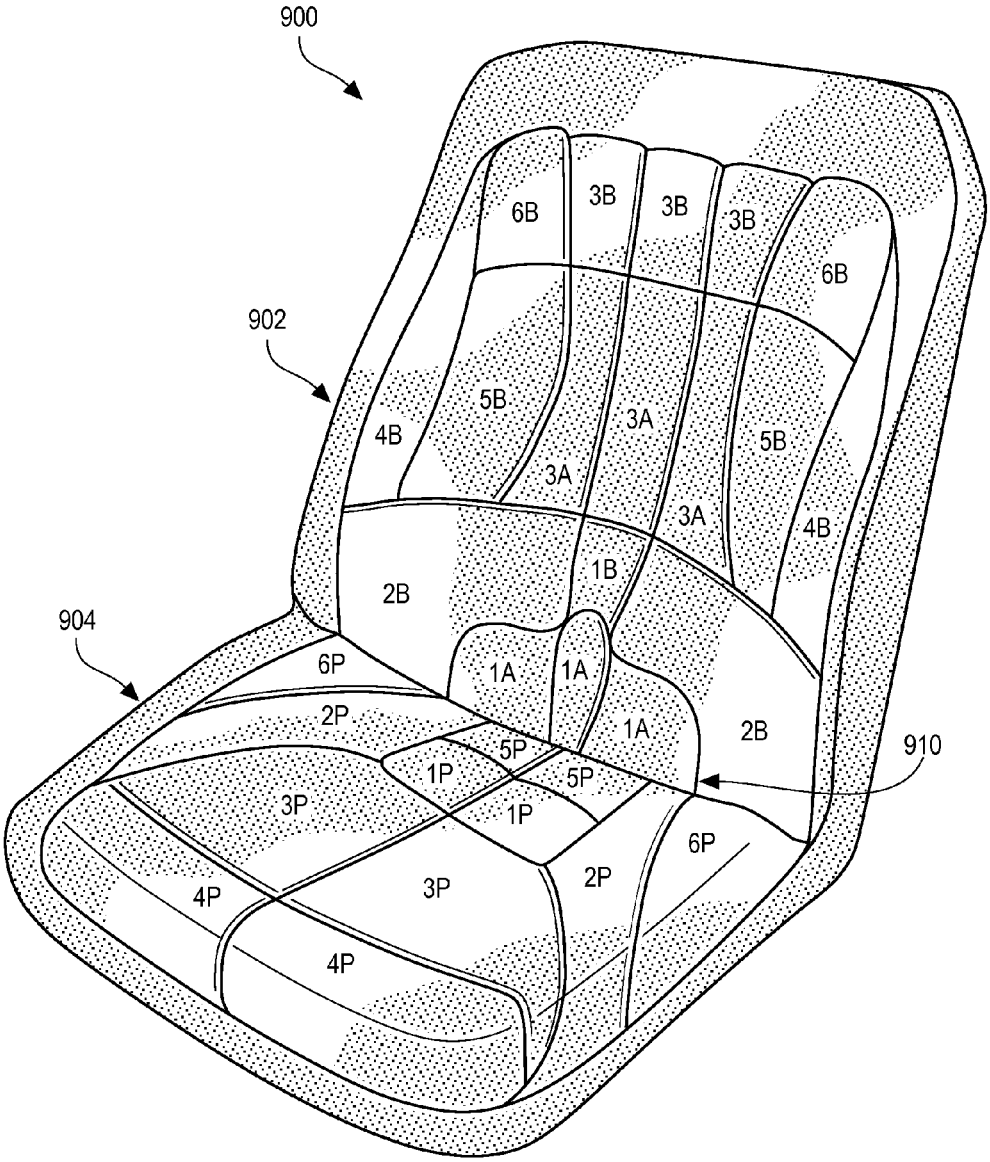
Figure 9:
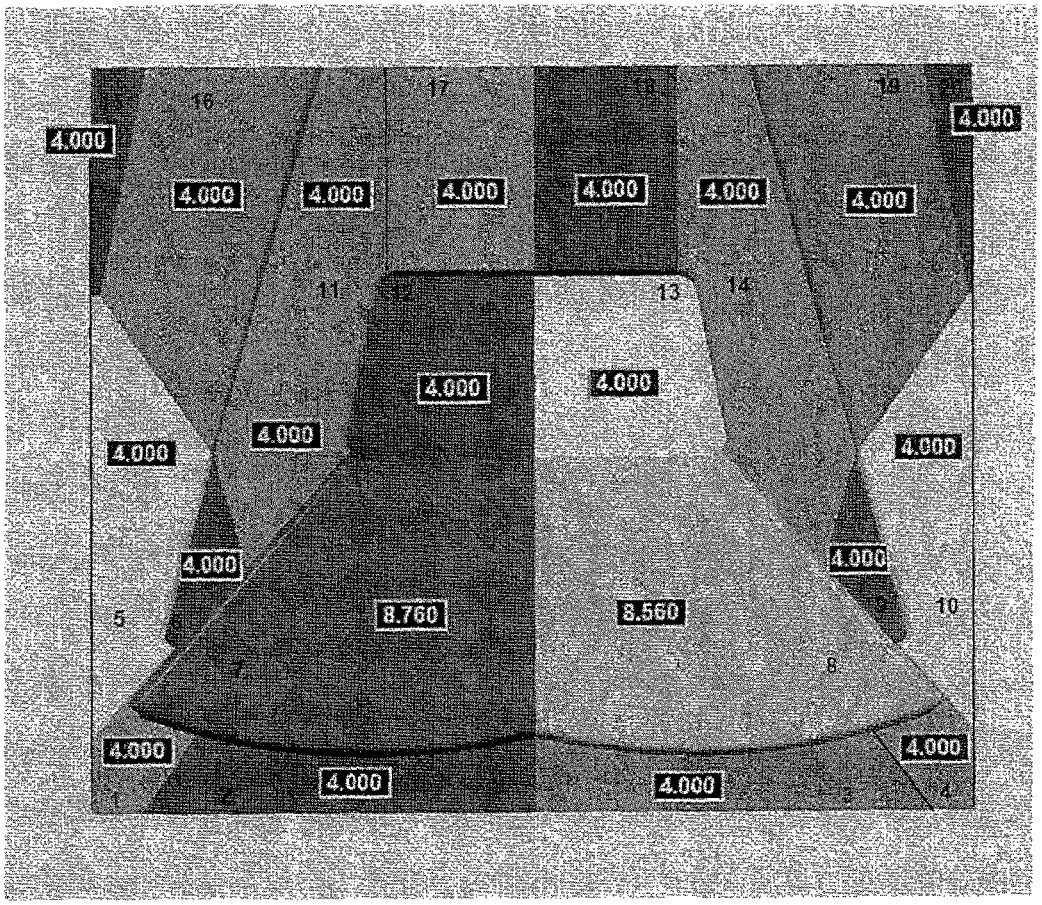
Figure 10:
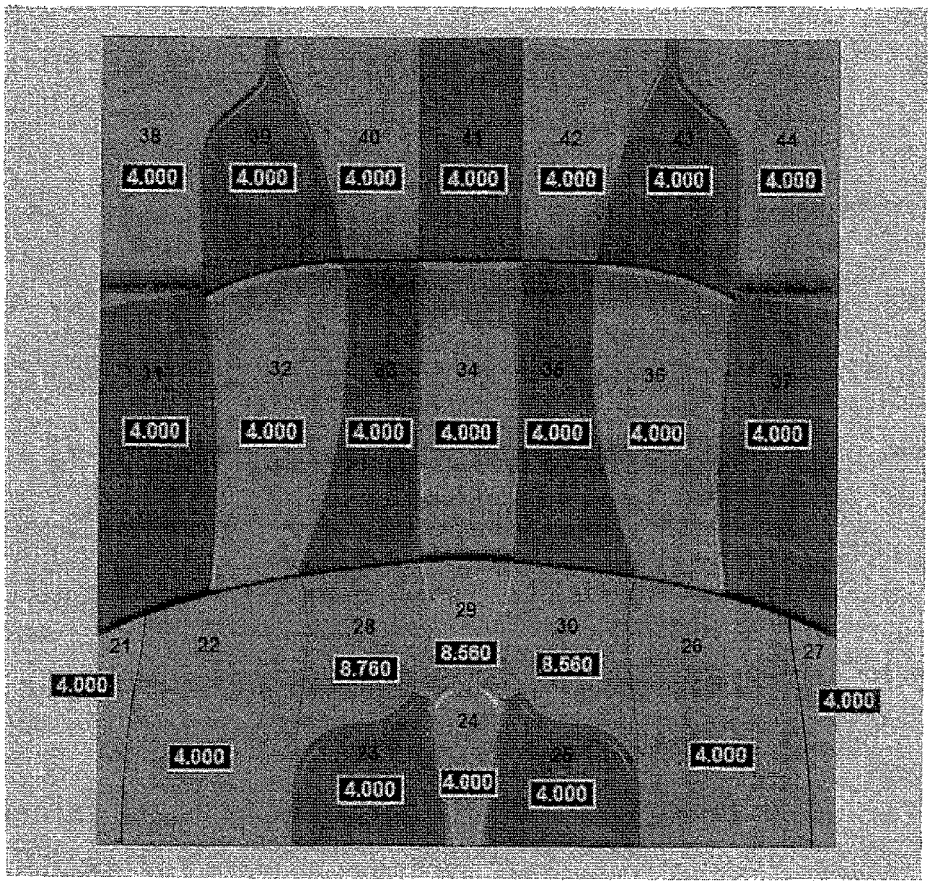
Figure 11:
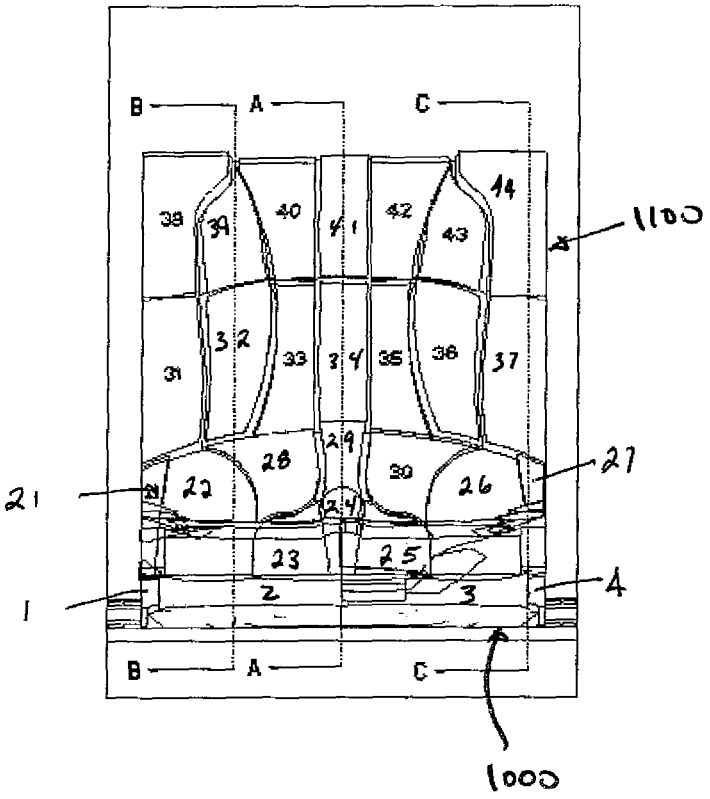
Figure 11A:
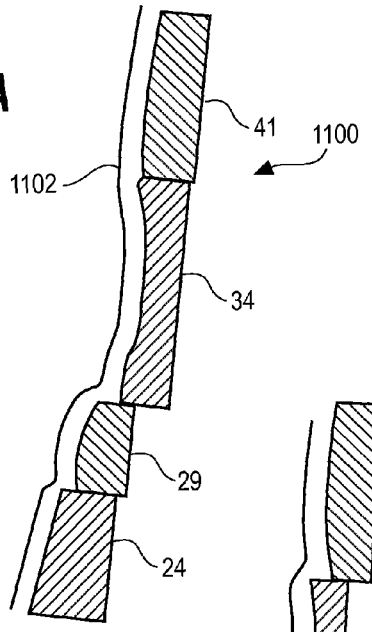
Figure 11A:
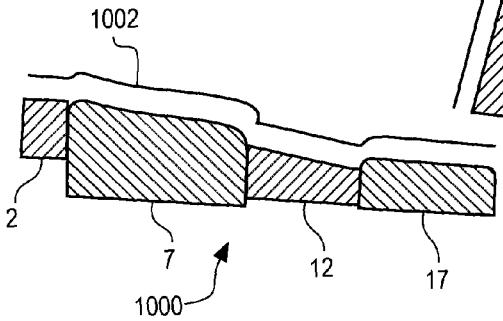
Figure 11A:
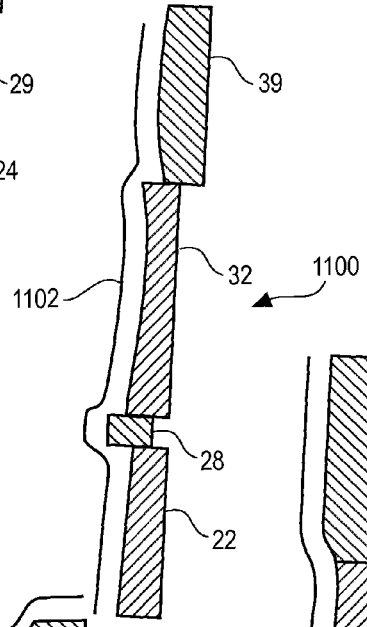
Figure 11B:
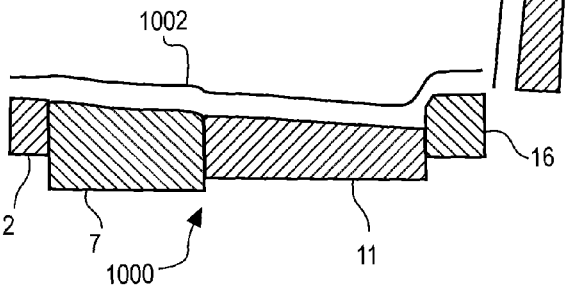
Figure 11B:
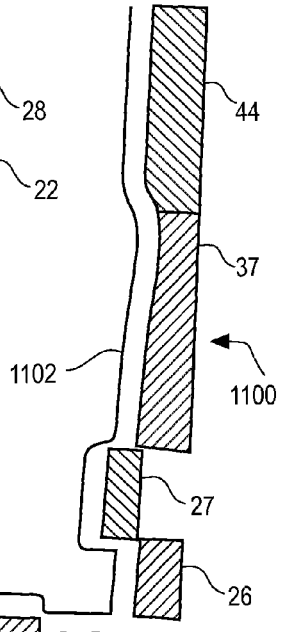
Figure 11C:
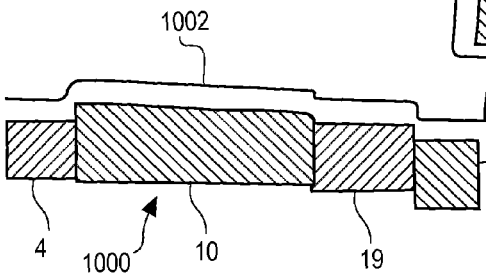
Figure 12:
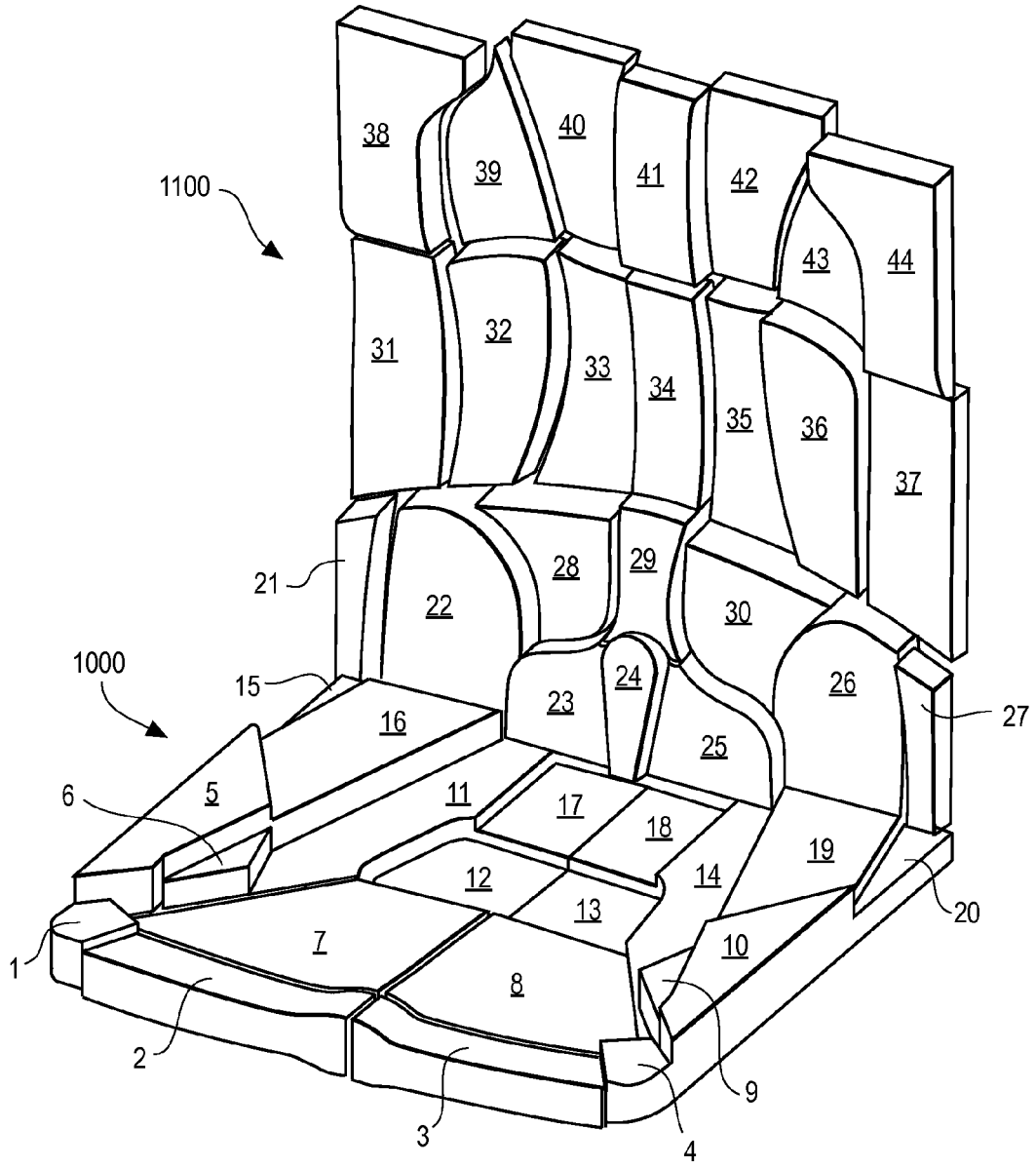

FIG. 7*a* is a cross sectional view taken along line 7*a*-7*a* in FIG. 7;

FIG. 7*b* is a cross sectional view taken along line 7*b*-7*b* in FIG. 7;

FIG. 8 is a photograph of a seat molded with multi-zoned supports;

FIG. 9 is a top elevational view of a seat pan or bottom showing another embodiment of a multi-zoned support;

FIG. 10 is a front elevational view of a seat back showing another embodiment of a multi-zoned support;

FIG. 11 is a front elevational view of a seat incorporating the multi-zoned supports shown in FIGS. 9 and 10 and where individual zones have been moved into an exemplary support position;

FIG. 11*a* is a cross sectional view taken along line A-A in FIG. 11;

FIG. 11*b* is a cross sectional view taken along line B-B in FIG. 11;

FIG. 11*c* is a cross sectional view taken along line C-C in FIG. 11; and FIG. 12 is a diagrammatic perspective view of the multi-zoned supports shown in FIGS. 9 and 10 with the individual zones having been moved into one exemplary supporting position.

Figure 13:
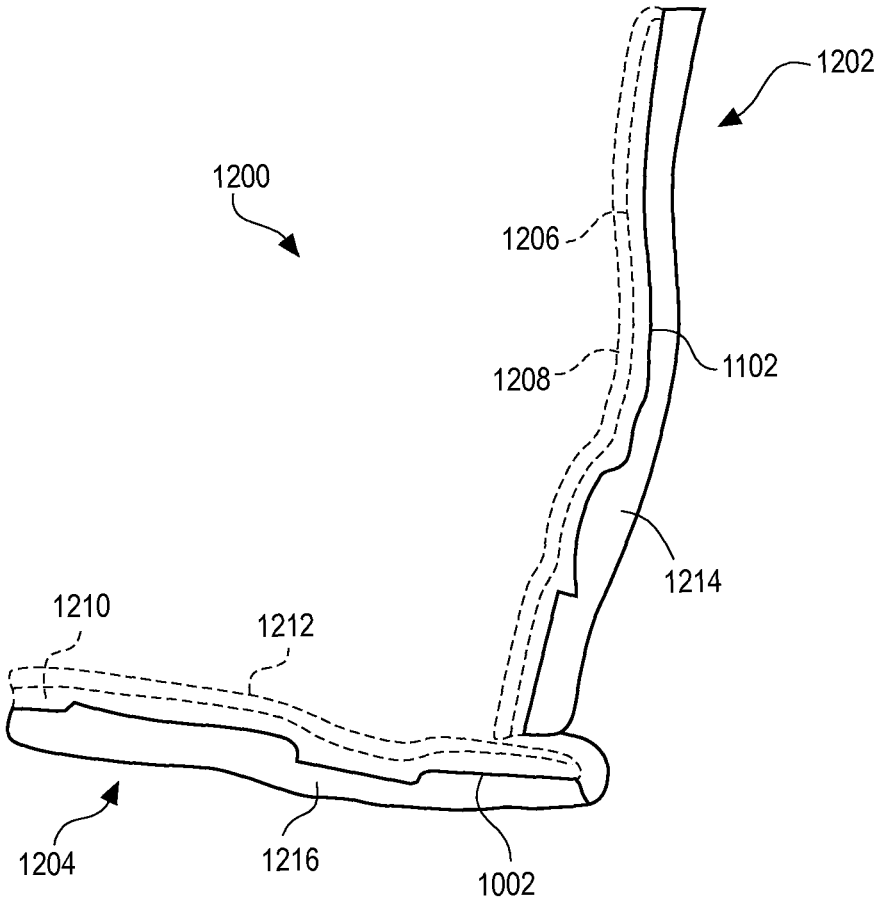

FIG. 13 is a cross sectional view of a seat back and seat pan.

DESCRIPTION

The invention concerns seating employing defined zones that are matched to the zones of anatomy, which, in turn, become supporting zones within the seating structure.

This following explanation identifies and explains the action of the anatomy within each independent support zone. The support system concept disclosed herein expands beyond individual zones by providing an inter-related system of control between zones, while in other cases the zones can be independent areas of support. In one embodiment the seat structure can include six (6) seat back zones and eight (8) seat pan zones. Each anatomical part of the support system is designed to perform a specific action. In addition, the seating can further include recoil or active response pieces or shields, that can be of varying size and shape from one piece devices, to segmented pieces that can correspond to the individual zones themselves or the recoil shields can be designed to span across some but not all zones or can span across specific portions of zones. Further, the recoil shields can be either made a part of the seat, by being adhered to the seat structure, they could be over molded and thus formed within the seat structure and within the zoned supports themselves or the recoil shields could be an insert that could be shaped, for example to replicate the zoned contour, or shaped to provide spring back and then merely inserted into the seat structure. That way, a seat could be easily modified to have the support itself be changeable.

The seat can be formed from a variety of materials including but not limited to foam, different foams, molded plastic members, or the seat can be the foam itself or a molded or otherwise shaped piece of material that has been shaped to replicate the zoned support structure, even without any covering of foam or a trim package. Further, the structure forming the zones can be tuned to provide similar or different support, the recoil shields can be shaped to produce some level of resistance or spring back to further the support and the response to loads placed on the seat by a seat user. Seats could also be formed from zoned sections in the form of chambers, for example, liquid or air filled chambers, or chambers that can be varied or adjusted by the amount of material that can be pit therein so that the chambers can be modified with more or less fluid so that the support can be varied.

Seat Back

Figure 1:
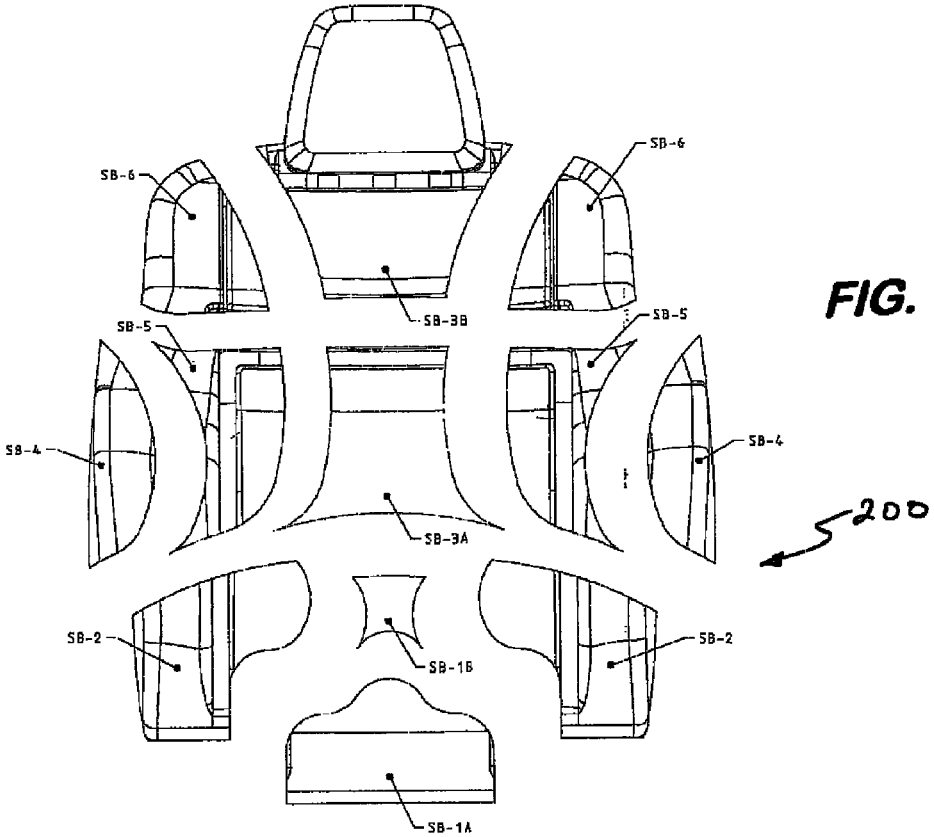
FIG. 1 is front elevational view of a seat back showing one embodiment of a multi-zoned support.

FIG. 1 shows a seat back at 200 and is comprised of a plurality of zones identified by zones SB-1A through SB-6. The zones can be better understood by reference to the following table where the zone and the anatomical part of human anatomy are paired together:

| Seatback Zone (SB) | Anatomical Part |
|---|---|
| SB-1A | Sacrum |
| SB-1B | Lumbar Vertebra Complex<br>Soft Tissues of the Lumbar Vertebral Complex and adjacent inter-related muscular skeletal joints and tissues |
| SB-2 | Ilium (2 Ilia)<br>Ilia and Soft Tissues of the Ilium and adjacent inter-related muscular skeletal joints and tissues |
| SB-3A | Thoracic (12 Vertebra of the spine) & Thoracic - Lumbar Spine Transition (2-6)<br>Thoracic & Thoracic - Lumbar Transitional complex and soft tissues of the adjacent inter-related muscular skeletal joints and tissues |
| SB-3B | Upper Thoracic & Cervical Thoracic Transition &<br>Upper Thoracic & Cervical Thoracic Transitional complexes and soft tissues of the adjacent inter-related muscular skeletal joints and tissues Ribs (12 Ribs) |
| SB-4 | Thoracic Skeleton<br>Ribs, Thoracic skeleton and the soft tissues of the adjacent inter-related muscular skeletal joints and tissues |
| SB-5 | Superior & Inferior Scapulae<br>Medial Rib Cage<br>Superior Ilia<br>Mid-Superior Medial Thoracic Skeleton<br>Superior & Inferior Scapulae, Medial Rib Cage, Superior Ilia, & Mid- Superior Medial Thoracic Skeleton and the soft tissues of the adjacent inter-related muscular skeletal joints and tissues |
| SB-6 | Shoulder<br>Superior Scapulae<br>Upper Thoracic<br>Shoulder, Superior Scapulae, Upper Thoracic and Cervical-Occipital transition and the soft tissue of the adjacent inter-related muscular skeletal joints and tissues |

Seat Bottom or Pan

Figure 2:
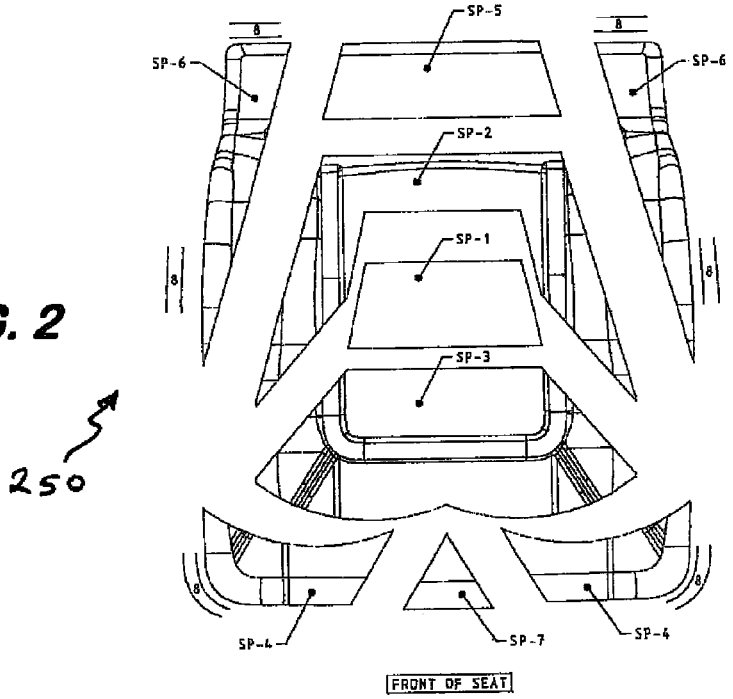
FIG. 2 is a top elevational view of a seat pan or bottom showing one embodiment of a multi-zoned support.

FIG. 2 shows a seat bottom or pan at 250 and is comprised of a plurality of zones identified by zones SP-1-SP-8. The zones can be better understood by reference to the following table where the zone and the anatomical part of human anatomy are paired together:

| Seat Pan Zone (SP) | Anatomical Prui |
|---|---|
| SP-1 | Ischial Tuberosities<br>Sacrum Apex |
| SP-2 | Hip Joints/Acetabulum<br>Sacrum and Femurs |
| SP-3 | Femurs |
| SP-4 | Distal Femurs |
| SP-5 | Posterior Pelvis (Posterior Gluteal Region) |

-continued

| Seat Pan Zone (SP) | Anatomical Prui |
|---|---|
| SP-6 | Hip Joints/Acetabular Complex<br>Proximal Femur |
| SP-7 | Medial Femur |
| SP-8 | Anatomical Perimeter<br>Outwardly most region of anatomical contact with Seat Pan's Perimeter |

The Seat Back

As noted above, FIG. 1 shows a seat back 200 as being comprised of a plurality of zones SB-1A-SB-6. Zone SB-1A is located at the bottom center of the seat back 200 and provides the primary stabilizing support of the sacrum and the adjacent soft tissues surrounding the sacrum.

The sacrum bone is a single triangular bone wedged in between the 2 hip bones (ilia) and transmits the weight of the human body to these bones via the sacroiliac joints. The sacrum's upper end articulates with the L5 vertebra and the inferior apex with the coccyx. It forms the posterior wall of the pelvic cavity and the 2 lateral surfaces articulate with the hip bones or (ilia). Enclosed within the bone is the sacral canal with its emerging sacral spinal nerves (the continuation of the lumbar vertebral canal). The sacrum bone transmits the weight of the human body to the hip bones (ilia) via the sacroiliac joints. The sacral angle heavily influences the pelvic angle, spinal curvatures, posture, and human performance.

The sacrum bone transmits the weight of the human body to the hip bones (ilia) via the sacroiliac joints. Further, the sacral angle heavily influences the pelvic angle, spinal curvatures, posture control, and human performance Posture Control is derived from achieving muscular-structural control of the angle and load of the sacral-pelvis region. Tilting of the pelvis is associated with changes in the spinal curvatures. For instance, forward tilting of the pelvis produces lordosis, and its backward tilt flattens the normal lumbar curvature. The sacrum heavily influences the dynamics of the adjacent joint and soft tissue structures. Zone SB-1A provides a controlled environment for supporting and/or stabilizing the angle of the sacrum comfortably and provides a controlled environment for supporting and/or stabilizing the amount of pressure and load distribution of the sacrum and the sacral-pelvis region. As with all zones, Zone SB-1A also provides a controlled, but natural compensating response to the occupant's postural changes that may be initiated from other zones.

Zone SB-1B is located at the center of the seat back 200 and just above the central area of zone SB-1A. Zone SB-1B provides support for the Lumbar Vertebra, primarily the Lumbar Vertebral Complex, Soft Tissues of the Lumbar, the Vertebral Complex and adjacent inter-related muscular skeletal joints and tissues. The term Vertebra refers to any of the 33 bones of the spinal column comprising 7 cervical vertebra (neck), 12 thoracic vertebra (mid back), 5 lumbar vertebras (low back), five sacral and four coccygeal vertebras. The Lumbar Vertebra is located between the thorax and the pelvis (low back). The spine may be thought of as a series of levers held together by joints and ligaments and kept in alignment, as well as operated, by muscles and the force of gravity.

Many of the anatomic structures that assure stability are also the ones that permit the column to move as freely as it does. These factors (adjacent inter-related muscular skeletal joints and tissues) are intervetebral disks, the ligaments (attach bones), Tendons (attach to muscles) the articular facets (joints) of the vertebral arch joints, and spinal musculature. The range and types of movements possible in each region of the spine are determined by the vertebral joints, but the control and strength of those movements depend on muscles (and other soft tissues). Muscles are essential for the stability of the spine, and for canceling out or controlling the effects of gravity. Strengthening of the abdominal muscles can relieve symptoms caused by strains on the vertebral column.

The human body is an inter-related system of systems and physics teaches that for every action there is a reaction. Therefore, if the neuro-muscular-skeletal systems are inter-related and inter-connected, the human body must respond to inertia and forces in a "compensating" manner. This multi-zoned seat design provides a system to support and control this compensating manner in all zones; in the case of SB 1B, it supports, stabilizes and controls the zone associated with the Lumbar Vertebral Complex, Soft Tissues of the Lumbar Vertebral Complex and its adjacent inter-related muscular skeletal joints and tissues. Tissues and joints include the other regions of the spine, pelvis (ilia), legs, ribs, scapulae shoulders and cranium.

Zone SB-2 is comprised of two left and right, mirrored sections that are designed to extend around zones SB-1A and SB-1B. Zones SB-2 is provided to support and stabilize the left and right Ilium (2 Ilia) and Soft Tissues of the Ilium and adjacent inter-related muscular skeletal joints and tissues. The ilium (pelvis) has (2) parts. That which contributes to the acetabulum (hip joint) is the body of the ilium. The rest of the bone projects upward from the acetabulum. The crest of the ilia terminates at its summit posteriorly in the PSIS (Posterior Inferior iliac spine). There are (2) I.T.'s, one for each hip bone (ilia). They consist of tuberosity's (protuberances) are two large bones located on the posterior (underneath each ilia). The sacrum is wedged in between the two ilia. And, the two I.T. bones, the 2 bones that we sit on, form the bottom portion of the ilia bones. The I.T.'s and the sacrum are also identified along with their anatomical actions and importance in Zones SP-1, SP-2, SP-5 and SP-6. The importance of SB-2's anatomical inter-relationship with other zones of anatomy should be highlighted because the tilting of the pelvis is associated with changes in spinal curvatures (posture) as pointed out earlier. In particular, posture (determined by the shape of the spine) regulates the human strength side of the human performance equation. Because of its strategic anatomical importance associated with spinal curvatures and posture control, Zone SBU-2 represents a key zone in a system of zones that controls comfort, posture and human performance. This multi-zoned seat design controls the angle and support of the pelvis via both the seat pan and the seat back. Zones SP-1 & SP-2 in the (seat pan) and Zone SB-2 in the (Seat Back).

Zone SB-2 provides a natural nesting environment for the PSIS's thus, improving the load distribution independently within its zone. Zone SB-2 also provides synchronized inter-zoned control primarily with adjacent zones SB-1A, SB-1B, SB-3A, SB-4 and SB-5. This multi-zoned seat design provides a contoured, forward and aft synchronized system and relationship between each of the plurality of zones. Ultimately a resulting contoured surface, controlled compression ratio, synchronized forward and aft movement or displacement of zones provides a collective zoned system that results in a way to form a seat that will manage and control the zones of the human anatomy independently and inter-dependently.

Positioned centrally and in the seat back 200, above zone SB-1B is zone SB-3A. Zone SB-3A is designed to provide support for and to stabilize the Thoracic and Thoracic/Lumbar Transitional complex and Soft Tissues of the adjacent inter-related muscular skeletal joints and tissues.

The distinguishing feature of a thoracic vertebra is the development of its costal elements into a pair of separate bones. Consequently, all thoracic vertebra (T1-T12) articulate with at least one pair of ribs. In fact, typical thoracic vertebra (T2-T9) articulate with two pairs of ribs; the head of a rib contacts a costal facet (fovea), or demifacet, on the superior margin of one vertebral body and a similar facet on the inferior margin of the vertebral body above. In addition, there is a costel facet on the transverse process of the upper ten thoracic vertebras. Mobility of the thoracic spine, particularly in its upper and middle regions, is limited mainly by the rib cage, but also by the narrowness of the intervertebral discs. Rotation of the trunk takes place primarily in the thoracic spine. Limitation of flexion, extension, and rotation can be camouflaged by movement at the hip joints. The vertebral column performs most of its functions as an integrated unit including the related muscular skeletal system may be viewed as a complex system of levers, pulleys and joints functioning interdependently but along with intercommunicating muscle groups between the spine, pelvis, ribs, scapulae and shoulders.

The range and types of movements possible in each region of the spine are determined by the vertebral joints, but the control and strength of those movements depend on muscles (and other soft tissues). Muscles are essential for the stability of the spine, and for canceling out or controlling the effects of gravity.

The thoracic spine (mid back) plays an important roll because it influences the trunk's postural position, strength, dynamic performance and response to task because several parts of anatomy including the shoulders and arms rely on the trunk for anchored leverage. In particular, posture, as determined by the shape of the spine, regulates the human strength side of the human performance equation. Because of its strategic anatomical importance associated with spinal curvatures and posture control, Zone SB-3A represents a key zone in a system of zones that controls comfort, posture and human performance. Respiration is influenced by thoracic strength and well being because the thoracic spine connects directly to the rib cage. The cranium weighs 8-12 lbs. Consequently, cranial support, cervical (neck) flexion, extension, and rotation result from shared muscles in the thoracic region, and therefore, the cranial-cervical muscles leverage much of its strength, ROM and action from the thoracic region. Because of the dependent inter-connected anchoring-muscular-relationship between the thoracic spine and the cranium, neck, scapulae, ribs, shoulder, lumbar and pelvis, this multi-zoned seat design provides a zone and a system to isolate and "secure or nest" the thorax in the seat (independent of the other zones) a vital tool in providing body control, strength, stamina. Zone SB-3A provides support and controls the angle, stabilization and support of the thorax/trunk. Zone SB-3A provides a natural nesting environment for the thoracic spine while it's in a kyphotic curvature thus, improving the load distribution independently within its zone. Zone SB-3A also provides synchronized inter-zoned control primarily with adjacent zones SB-1B, SB-2, SB-5, SB-3B, and SB-6.

By the articulation and/or adjustment of the zones, one relative to the other, a contoured surface providing the desired support can be created and this will be more fully explained hereinafter. None the less, such a contoured surface, when incorporated within a molded foam layer, as by over molding, or when used by itself or used in conjunction with a foam layer over lay it will provide a nested support for the human anatomy. Further by modifying the density of the foam used for over molding or with the foam used as an overlay, such a contoured surface provides an anatomically sensitive support structure. Such a contoured surface can also result from a synchronized forward and aft movement or displacement of the pieces defining the individual zones.

Zone SB-3B is also a centered zone and is located above zone SB-3A. Zone SB-3B is provided to supply support for the upper Thoracic and Cervical-Thoracic transitional complex and the soft tissues of the adjacent inter-related muscular skeletal joints and tissues. The range and types of movements possible in each region of the spine are determined by the vertebral joints, but the control and strength of those movements depend on muscles (and other soft tissues). Muscles are essential for the stability of the spine, and for canceling out or controlling the effects of gravity. They fall into two major functional groups: extensors and flexors. Each group is capable of rotating and laterally bending the column.

Because of the dependent and inter-connected anchoring-muscular-relationship between the thoracic spine and the cranium, neck, scapulae, ribs, shoulder, lumbar and pelvis, this multi-zoned seat design provides a zoned system that will isolate and "secure or nest" the upper thorax in the seat, independently of the other zones, and zone SB-3B provides support for this area in a way that provides support for both static or dynamic tasks. Cranial support, cervical (neck) flexion, extension, and rotation result from shared muscles in the entire thoracic region, and therefore, the cranial-cervical muscles leverage much of its strength, ROM and action from the thoracic region. As mentioned, the cranium weighs 8-12 lbs. and therefore, requires well defined origin and insertion anchoring and attachments. Unlike traditional seating, this support approach controls the angle, stabilization and support of the upper thorax/trunk in zone SB-3B and provides a natural nesting environment for the upper thoracic spine. The adjacent and inter-connected zones are dependent upon the stability and strength of the upper thoracic anatomy to function properly. Anatomy such as cervical, cranial/occipital, scapulae, shoulder and mid thoracic spine and ribs share inter-connecting muscle attachments and therefore depend upon the performance of the upper thoracic region.

Zone SB-4 is another mirrored zone with right and left sections located at the mid-point of the seat back and at the outer edges thereof, above zones SB-2 and outwardly from zones SB-5. Zone SB-4 provides support for the ribs, the Thoracic skeleton and the soft tissues of the adjacent inter-related muscular skeletal joints and tissues. The thorax skeleton includes the rib cage and the thoracic vertebral column and form an irregularly shaped, truncated cone. Ten of the twelve pairs of rib form loops or arches between respective vertebra and sternum, whereas the last two pairs of ribs float free anteriorly (floating ribs). All ribs slant downward from their vertebral attachments. Movement of the skeletal pieces is required for respiration, and these movements are mediated by several joints. During inspiration, reduction of the intrathoracic pressure is brought about by increase in the anteroposterior, lateral, and vertical diameters of the thoracic cavity. The vertical increase is due to diaphragmatic movement, whereas the anteroposterior and lateral increases depend on movement of the ribs. When the head of a rib articulates with two vertebral bodies, the cavity of the joint is divided by a ligament attaching the crest of the head to the intervertebral disc. The boney shaft of each rib is directly united to it cartilage; each typical costochondral loop articulates with the thoracic spine and another joint joins to the sternum.

Because of the inter-connected anchoring-muscular-relationship between the ribs and the thoracic spine, thorax cavity, process of respiration, cervical spine (neck), scapulae, shoulders, lumbar and pelvis, this multi-zoned seat design provides a zoned system to isolate and "secure or nest" the ribs in the seat (independent of the other zones) because Zone SB-4 is a tool in providing thorax and rib cage stabilization and it controls the angle, stabilization and support of the rib cage and lateral thorax as well as the superior lateral pelvis (ilia) in Zone SB-4. The adjacent and inter-connected zones are dependent upon the stability and strength of the ribs, lateral thorax and superior lateral ilia to function together properly and Zone SB-4 provides a natural nesting environment for these zones to perform comfortably and safely in the seat without pressure points, medial force, seating design constraints and/or restriction of their natural ROM. Use of zone SB-4 reduces the need for large lateral seat bolsters which inhibit fit, increase wear and tear on the seat and act as potential safety issues post impact. Further, zone SB-4 provides synchronized inter-zoned control primarily with adjacent zones SB-2, SB-3A, SB-5, and SB-6.

Zone SB-5 is also located at the mid-point of the seat back 200 and is positioned between zones SB-4 and zone SB-3A and above zone SB-2. Zone SB-5 provides support for the superior/inferior scapulae, the medial rib cage, superior Ilia, the mid-superior medial Thoracic skeleton and the soft tissues of the adjacent inter-related muscular skeletal joints and tissues. The Scapulae, or shoulder blade, is the posterior component of the pectoral girdle skeleton. It is a flat triangular bone that lies with its anterior surface against the thoracic cage. The scapulae have no direct attachment to the axial skeleton, for it is attached to the ribs and the vertebral column by muscles only. Its connection to the axial skeleton is indirect via the clavicle. The base of the scapulae (superior aspect) is opposite the spinous process of T-3, and the inferior angle of the scapulae is on the level of T-7. Although the scapulae are largely buried in muscle, movements can readily be observed from the back.

Because of the inter-connected anchoring-muscular-relationship primarily between the scapulae, ribs and thoracic spine; and secondarily between the clavicle, shoulder and cervical (neck) and occipital anatomy, zones SB-5 isolate and "secure or nest" the scapulae in the seat. The scapulae surfaces on the back are due to the posterior protrusion of the scapulae and its primary muscles (Rhomboideus major and Teres major). Unlike traditional seating, this multi-zoned seat design, and zones SB-5 in particular, provide specific control for the nesting, stabilization and support of the scapulae and for a indiscrete load distribution surface for its medial border (the trapezius muscle). Zone SB-5 provides a natural nesting environment for the scapulae to perform comfortably and safely in the seat without pressure points and/or restriction of the scapulae's natural ROM.

Zone SB-6 is in the form of two mirrored zones at the upper outer corners of the seat back 200, and are positioned above zones SB-5 and outside of zone SB-3B. Zone SB-6 provides support for the shoulder, the superior scapulae, the upper Thoracic and Cervical-Occipital transition and the soft tissues of the adjacent inter-related muscular skeletal joints and tissues.

In the most inclusive sense, the shoulder encompasses the square prominence made up of the acromial and deltoid regions, the shoulder joint along with the acromioclavicular joint, and the scapular region in the back, including the muscles that attach the scapulae to the vertebral column from the skull to the sacrum. The pectoral region, axilla, and shoulder are those regions of the body that link the free upper limb to the trunk. The soft tissues of these regions are supported mainly by the bones of the pectoral girdle, the clavicle and the scapulae and by the upper end of the humerus. The movements of the pectoral region depend upon three joints: the sternoclavicular joint, which allows movement between the pectoral girdle and the axial skeleton; the acromioclavicular joint which unites the clavicle and the scapulae; and the glenohumeral joint, which permits movement of the free limb relative to the pectoral girdle.

The muscles responsible for moving these joints can be classified into two major groups: those that move shoulder girdle in relation to the axial skeleton; and those that move the free limb relative to the girdle skeleton. Muscles of the first group originate from the vertebra, the sternum, or the ribs, and insert into the clavicle or scapulae. Their actions displace the shoulder as a region or body part: the shoulder can be elevated or depressed, as well as thrust forward (protracted) or braced back (retracted). Each of these movements takes place at the sternoclavicular joint. Muscles in the second group originate from either the axial skeleton or the pectoral girdle (clavicle or scapulae) and insert into the humerus. They cause movement of the free limb relative to the girdle. As this joint is a ball-and-socket variety, several types of movement are possible, and the muscle groups that act on the joint are correspondingly diverse. They comprise flexors, extensors, abductors, adductors, and lateral and medial rotators. Muscles in all these functional groups receive nerve supply from the brachial plexus. The brachial plexus is an ordered network of large nerves through which sensory and motor nerve supply is distributed to all structures that constitute the upper limb. The brachial plexus is formed by the cervical vertebra 5 and thoracic vertebra 1 spinal nerves.

Because of the massively important inter-connected anchoring-muscular-relationship between the shoulder and the free limb, spinal column, cranium, neck, scapulae, ribs, pelvis and sacrum, this multi-zoned seat design and zones SB-5 provide an independent shoulder zone and a system to isolate and "secure or nest" the shoulder (independent of the other zones) and zone SB-6 controls the angle, stabilization and support of the shoulder and a natural nesting environment for the shoulder without excessive use of lateral support.

The Seat Bottom or Pan

By definition "sitting" is a body position in which the weight of the body is transferred to a supporting area that involves many body parts, including muscles, bones, ligaments, soft tissues and so on. In zone SP-1 the support effects mainly by the ischial tuberosities, hereafter "I.T." of the pelvis and their surrounding soft tissue. There are two (2) I.T.'s, one for each hip bone (ilia) and so SP-1 has a sufficient breadth to support both of the ischial tuberosities.

A secondary portion of the anatomy supported by the zone SP-1 is the sacrum. The sacrum is a single triangular bone wedged in between the two hip bones or ilias and transmits the weight of the human body to these bones via the sacroiliac joints. The sacrum's upper end articulates with the L5 vertebra and the inferior apex with the coccyx. It forms the posterior wall of the pelvic cavity and the two lateral surfaces articulate with the hip bones ilias. Enclosed within the bone is the sacral canal with its emerging sacral spinal nerves (the continuation of the lumbar vertebral canal).

Zone SP-1 is shaped to provide primary support of the two I.T.'s as these are the two bones that a person primarily sits on and they represent the point of contact for the pelvis with the seat bottom. Therefore, the environment of the I.T.'s heavily influences the angle of the pelvis, posture, circulation and human performance. In addition, the sacrum bone transmits the weight of the human body to the hip bones (ilia's) via the sacroiliac joints and therefor the angle at which it is held, the sacral angle, heavily influences the pelvic angle, spinal curvatures, posture, and human performance.

In addition, the I.T.'s angle of nesting and transitional load distribution at the point of contact translates into posture control which is derived from achieving muscular and structural control of the attitude and load of the pelvis and it's effect on the adjacent soft tissue and joint structure dynamics. This provides anatomical compensation and begins with I.T. static & motion dynamics.

By achieving proper attitude and control over the anatomy, one can achieve anatomical compensation as well as control over the occupant's anatomical efficiency via posture control and therefore represents a key step in achieving seating comfort. Zone SP-1 provides a controlled environment for both the IT.'s and the sacrum. Further, Zone SP-1 also provides a controlled but natural compensating response to the occupant's postural changes that may be initiated from other zones. In this regard, it should be understood that all zones are inter-related and inter-communicate and this multi-zones seat provides for a controlled response, one zone to the others. Each zone reacts within its own zone independently according to forces.

Zone SP-1 establishes control over the anatomy and transitional load distribution of the I.T.'s for 2 reasons:

- The I.T.'s will experience aggressive point loading and the occupant will suffer physically
- this process will set off a compensatory muscular skeletal chain reaction as the occupant seeks relief from either the point loading or the fatigue created by the insufficient support
- In both instances, the occupant will suffer poor posture, fatigue, and discomfort.

While this multi-zone approach provides the correct support for the I.T.'s, it is paramount during this process to prevent restrictive motion of adjacent tissues and joints. Preventing restrictive motion of adjacent tissues and joints is an integral part of this seat design.

Zone SP-2 is the next zone and lies both behind zone SP-1 and runs along each side of zone SP-1. Zone SP-2 has a primary support function for the Hip Joints/Acetabulum, a secondary support of the Sacrum and for a third portion of the anatomy the Proximal Femur.

Turning first to the primary anatomy supported by zone SP-2, the Hip Joints/Acetabulum, this includes the gluteal (hip regions) which are those parts of the body that link the free lower limb to the trunk. These joints share the responsibility of bearing the entire body weight and affect the stability and movements of the pelvic girdle, and the sacroiliac joints, which unite the girdle to the axial skeleton. The hip joints allow the pelvis to tilt or rotate at the hip in any direction. Consequently, it is important to appreciate that the function of muscle groups serving the hip, which are controlling its tilt in those positions where its ligaments alone cannot counterbalance the gravitational force.

As a second portion of the anatomy supported by zone SP-2 is the sacrum, which, as noted above, is a single triangular bone wedged in between the two hip bones (ilia's) and transmits the weight of the human body to these bones via the sacroiliac joints.

A third portion of the anatomy supported by the zone SP-2 is the proximal femur. Although the femur belongs to the free limb, it is included during the description of the functional pelvis. The proximal end of the femur is indispensable for understanding several topics related to pelvic functions. It participates in forming the hip joints and it allows greater mobility at the hip joint, but also imposes unusual strains on the neck of the femur because the body weight has to be transmitted thru an arc. Rotary movements at the pelvis take place at the proximal end of the femur and this is important in considering muscle action at the hip. Rotary movements at the pelvis take place at the proximal end of the femur and this is important in considering muscle action at the hip.

Zone SP-2 is important since it provides unrestricted acetubular range of motion (ROM) and the transitional load distribution between zones SP-2, SP-5 and SP-6 will combine to manage the acetubular ROM, support and stabilization. The acetubular structures must be able to achieve proper eversion vs. inversion, medial to lateral or elevation changes uninhibited. The acetubular structures and adjacent joint and soft tissue structures combine to play a key roll in managing body control, strength, balance, and its ability to compensate to forces. When there is constriction, or binding of the acetubula ROM (Range of Motion) the consequences are failed human performance and any prospect for seating comfort.

Zone SP-3 has as its primary support focus on the femurs in each leg of a seated individual. Although the femur belongs to the free limb, it is included during the description of the functional pelvis. The proximal end of the femur participates in forming the hip joints, it represents the "ball" in ball-in socket, and it allows greater mobility at the hip joint, and also imposes unusual strains on the neck of the femur because the body weight has to be transmitted thru an arc. Rotary movements at the pelvis take place at the proximal end of the femur and this is important in considering muscle action at the hip. The distal end of the femur forms part of the knee joint. Specifically, the lower end of the femur terminates in contact with the tibia to form part of the knee joint. An increase (anteversion) or decrease (retroversion) in the angle of torsion influences rotation of the limb at the hip resulting in rotation of the lower limbs. Zone SP-3 provides a natural unobstructed continuation of Zone SP-1 and is specific to the femur and it's adjacent joint and soft tissue structures. Zone SP-3 also provides for unrestrictive ROM and proper eversion (turning outward) vs. inversion (turning inward) of the femur, knee and pelvis and their respective adjacent joint and soft tissue structures.

As with all other zones, Zone SP-3 has the power to influence other zones and visa versa. Because this femur ("Thigh") anatomy links the lower part of the lower extremity to the pelvis and consists of large muscles, muscle mass, and nerves, this multi-zones seat design. provides the correct zone reaction to forces in order to promote natural circulation, femur angle and reaction to the forces of other zones.

Zone SP-4 has left and right segments on the front outside corners of the seat to support the distal femurs, the lower end of which terminates in contact with the tibia to form part of the knee joint. An increase (anteversion) or decrease (retroversion) in the angle of torsion influences rotation of the limb at the hip resulting in rotation of the lower limbs. Zone SP-4 provides a natural unobstructed continuation of Zone SP-3 and its adjacent joint and soft tissue structures for the same reasons as stated for SP-3 above. Zone SP-4 also provides for the unrestrictive ROM and proper eversion vs. inversion of the femur, knee, tibia, fibula, and pelvis and their respective adjacent joint and soft tissue structures all influencing healthy posture and human performance.

Zone SP-5 is located rearwardly of zone SP-2 and between zones SP-6. It primarily supports the posterior or pelvis or the posterior gluteal region of the anatomy. When seated, the weight of the body is transferred to a supporting area mainly by the ischial tuberosities of the pelvis and their surrounding soft tissue and this includes the posterior gluteal region. The gluteal or pelvis and hip regions are those parts of the body that link the free lower limb to the trunk. This multi-zoned seat design uses Zones SP-5 & SP-6 to provide a continuation of unobstructed anatomical performance by Zones SP-1, SP-2 and SP-8, the seat's perimeter. These areas of the seat pan are independent zones for anatomical nesting and established a usefulness in their inter-related influence on the anatomy while working together with the other zones.

Zones SP-5 and SP-6 in combination with adjacent zone SP-8, the seat perimeter, influence the occupant's posture, performance, load distribution and comfort by controlling the rearward aspect of the seat pan.

The anatomical influence of zones SP-5 and SP-6 include, but is not limited to improving circulation, muscular-skeletal biomechanics, endurance, strength, and sense of balance, all effecting task performance. However, the influence of these two zones depends upon numerous factors, including the application of each seating component, postural attitude, and/or the combined reaction of all of the seating components. This multi-zones seat design provides a way to react to and comply with these forces and elements. The zones can either "respond to" or "force" modification of load distribution within their zone and/or other zones collectively. Zones SP-5 and SP-6 can either "respond to" or "force" modification of load distribution or they can "force" surface load distribution in the rest of the seat bottom by influencing anatomical load distribution. This translates into a profound effect on not only load distribution, but also the occupant's sense of balance, strength and endurance.

Zone SP-6 is positioned outside of zone SP-5 and extends forwardly along the outer portion of zone SP-2 up to where zone SP-4 is located. Zone SP-6 supports the hip joints, the Acetubular complex as well as the Proximal Femur. As noted previously, the gluteal and hip regions are those parts of the body that link the free lower limb to the trunk. This joint shares the responsibility of bearing the entire body weight. The joints at which stability and movements need to be controlled are the hip joints, which link the free limb to the pelvic girdle, and the sacroiliac joints, which unite the girdle to the axial skeleton. The hip joint is called the ball-and-socket joint: therefore the pelvis may tilt or rotate at the hip in any direction. Consequently, it is important to appreciate that the function of muscle groups serving the hip, controlling and preventing its tilt in those positions where its ligaments alone cannot counterbalance the gravitational force.

Secondarily, zone SP-6 supports the proximal femur and helps control rotary movements at the pelvis so that they take place at the proximal end of the femur and this is important in considering muscle action at the hip. The proximal femur's angle of torsion at the hip, influences the rotation of the limb. The proximal end of the femur is indispensable as it participates in forming the hip joints and as noted above, it represents the "ball" in ball-in socket and it allows greater mobility at the hip joint, and also imposes unusual strains on the neck of the femur because the body weight has to be transmitted thru an arc.

When zones SP-5 and SP-6 are integrated with the remaining aspects of the seat bottom's perimeter's design these zones affect the entire performance of the seat and the occupant. Further, the influence on support and comfort provided by zones SP-5 and SP-6 also depends upon numerous factors, including the application of each seating component, postural attitude, and/or the combined reaction of all of the seating components. The zones become more influential as the materials become less compliant.

Zone SP-7 is located at the center of the front edge of the seat pan and is preferably a triangular shaped zone positioned between the two parts of zones SP-4. Zone SP-7 supports the medial femur or femoral region and is one of the 3 segments supporting the lower free limb. The free lower limb is an extension of the gluteal and hip regions and there is both anatomic and functional continuity between the pelvic girdle and the free limb, as there is between regions and segments of the free limb itself. The thigh is distinguished by its massive musculature and links the pelvic girdle to the other segments of the free limb. The free limb is linked together by crossing one region to another, not just by muscles and tendons that move the joints, but also by nerves and vessels.

Zone SP-7 can be viewed as a natural continuation of Zones SPU-2, SP-3, SP-4 and SP-8 and it continues to provide unobstructed (ROM), comfort (not too hard) and a natural anatomical resting place for the femur (thigh). Further zone SP-7 defends the mid-line of the seat by disallowing inversion (forced medial movement) of the femur which is generally caused by the Hammocking or sagging of the traditional seat. Traditional seats are "harder" near the perimeter so when the seat pan is loaded the central portion of the seat compresses more than the perimeter; thus, the term "Hammocking." Hammocking is created by "hard" perimeters and translates into increased and uncomfortable pressure on the anatomy along the perimeter. "Hammocking" also causes the pelvis & femur's (thighs) to be forced medially.

As it pertains to the femurs, when forced medially it causes restriction and reduced freedom of movement for the joints associated with (or adjacent to) the femur; in this incidence, the pelvis, hip and knee joints. Restrictions in these areas spread rapidly to the other anatomical zones leading to dysfunctional or handicapped anatomic performance in all zones. In an effort to further clarify: the muscular skeletal system may be viewed as a complex system of levers, pulleys and joints functioning independently and interdependently under the motive power of inertial forces and forces supplied by the contractile properties of muscles; it's a linkage system of joints and soft tissues. Therefore, when any joint or any soft tissue is restricted or prohibited from functioning in its natural ROM, it eventually translates to problems for the rest of the zones (joints & soft tissues). Because the human body is a shared linked system, any zone can directly affect the performance of an adjacent zone, or indirectly affect all other zones. Any one zone is capable of initiating this sequence of events.

Based on this, if the femur is forced medially for any reason (i.e., "hammocking" or "hard & rigid perimeter"), it results in restrictive performance of one or more zones, or eventually the entire set of zones. The affects result in poor anatomical performance which leads to obstructions with circulation, muscular-skeletal biomechanics, endurance, strength and physical comfort.

Zone SP-8 represents the circumference of the seat pan. It is not really a "Zone" as compared to the other zones as they appear in SP-1 through SP-7, but SP-8 should be viewed as a way to identify the entire seat perimeter. None the less, zone SP-8 can be divided into sub zones or sections and each sub zone in SP-8 can provide a differently controlled response (compression ratio/active responsive force) along the perimeter. SP-8 in its entirety, and/or via the use of sub zones will provide a variety of active response forces that will further the goal of providing a manageable, controlled active response to load distribution throughout the entire surface of the seat pan. By managing the active response of the seat's perimeter, this multi-zoned seat design provides a much improved "zoned" environment making anatomical nesting a reality.

In current seating designs, the anatomical nesting environment is interrupted by a "hard" or "rigid" or "noncompliant" section or sections of the perimeter. A "hard" or "rigid" or "harmoniously noncompliant" perimeter interferes with the anatomical performance of the other zones. By understanding the dynamics explained in Zone SP-7, it is easy to understand the influence that the perimeter Zone SP-8 has on the entire seat pan. The seat perimeter vastly influences the anatomy, and therefore, the occupant's ability to achieve healthy comfort.

Figure 3:
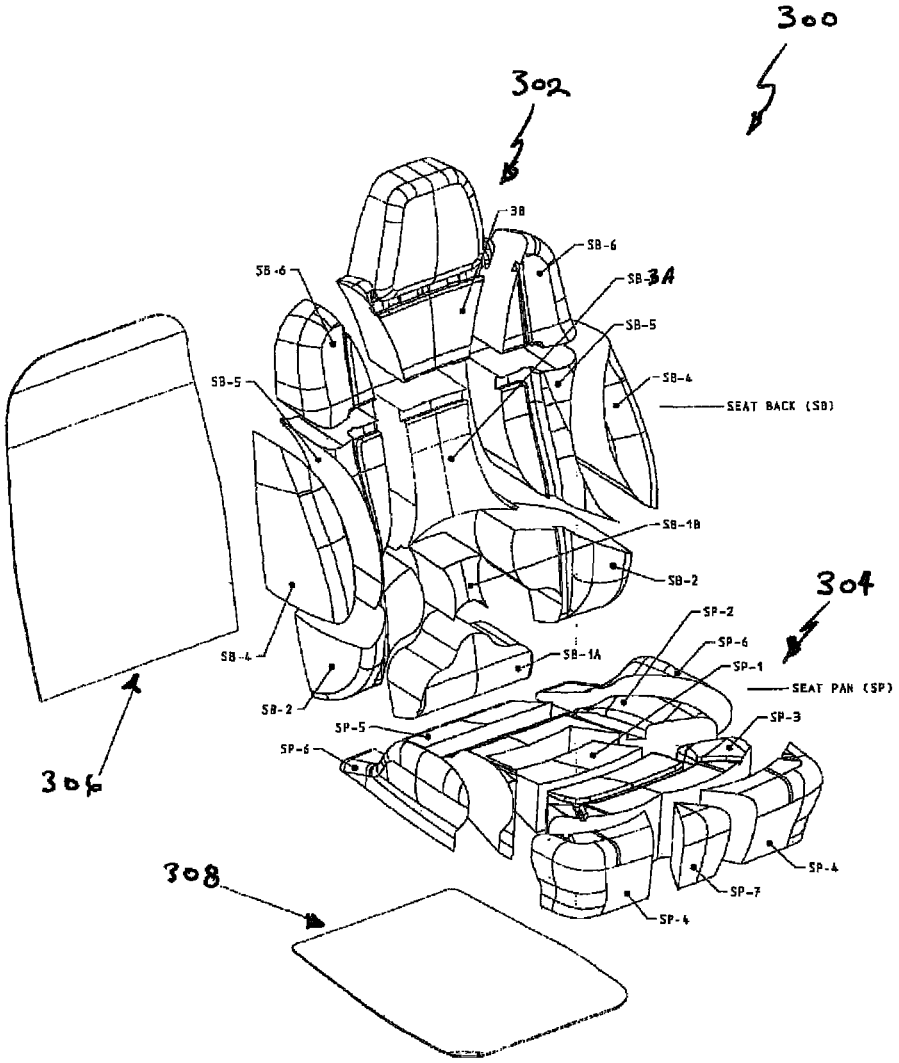
FIG. 3 is a perspective view of one seat embodiment incorporating the multi-zoned supports shown in FIGS. 1 and 2 and incorporating a one piece recoil shield in the seat back and seat pan.

FIG. 3 shows an embodiment where the multi-zoned seat design, discussed above with regard to FIGS. 1 and 2, is now made into a seat 300 comprised of a seat back 302 and seat pan 304. Each includes the plurality of zones discussed above and could be formed from molding a multi-zoned foam product in a mold shaped in a manner corresponding to the multi-zoned design as described. The foam can be a polyurethane, such as an open cell, flexible or semi-rigid foam and it can exhibit a uniform density or hardness of, for example about 20-60 Shore 000 durometer, and preferably about 30-50 Shore 000 durometer, or a density of about 1.5-4.0 pcf, or can be varied from zone to another zone to yield a zoned seat with the support that is desired.

In addition, and as an alternative design where additional support of the zoned design might be helpful, a recoil shield as is shown at 306 could be incorporated in or used with the seat back 302. A similar recoil shield 308 could also be used with the seat pan 304.

In this embodiment each recoil shield, 306 and 308, is a one piece structure that can be formed from a relatively thin, flexible material, such as, for example, but not limited to plastic, metal, reinforced materials such as fiberglass, poly carbonate, thermoplastics and the like. The recoil shields 306 and 308 will work with the multi-zoned pieces or structures to provide an additional level of support for them and, for example, relative to a support frame (not shown). Alternatively, the recoil shields 306 and 308 could be incorporated into a molded product formed in a multi-zoned mold, again having a design corresponding to the plurality of zones as described above for each of the back and pan structures.

An example of a molded seat, formed from molded foam sections, is shown in FIG. 7 along with the cross sectional views of FIGS. 7*a* and 7*b*. FIG. 7*a* shows in dotted lines a recoil shield at 160 that is located at the rear of the zoned sections forming the seat back and, alternatively, a recoil shield 162 that is embedded within the molded foam seat back, is an example of over molding. In a similar manner, the seat pan can include a recoil shield 164 located along the bottom exterior of the zoned sections, or alternatively, a recoil shield as shown at 166 could be embedded or formed to be positioned within the molded structure. Each recoil shield will provide additional stability for the zones and can be tailored to provide the support desired depending upon the density of foam being used in each section as one skilled in the molding arts will readily appreciate.

Recoil shields like those shown at 160-166, 306 and 308 can be formed from thin sheet stock with a thickness that can vary from 1/32 of an inch to 1/4 inch depending upon the amount of support desired. The thinner the recoil shield the more flexibility will be available and as the thickness increases the flexibility of the zones will diminish.

It should be under stood that a seat does not need a recoil shield, but rather can simply be formed from foamed sections corresponding to the zoned design described above.

Figure 4:
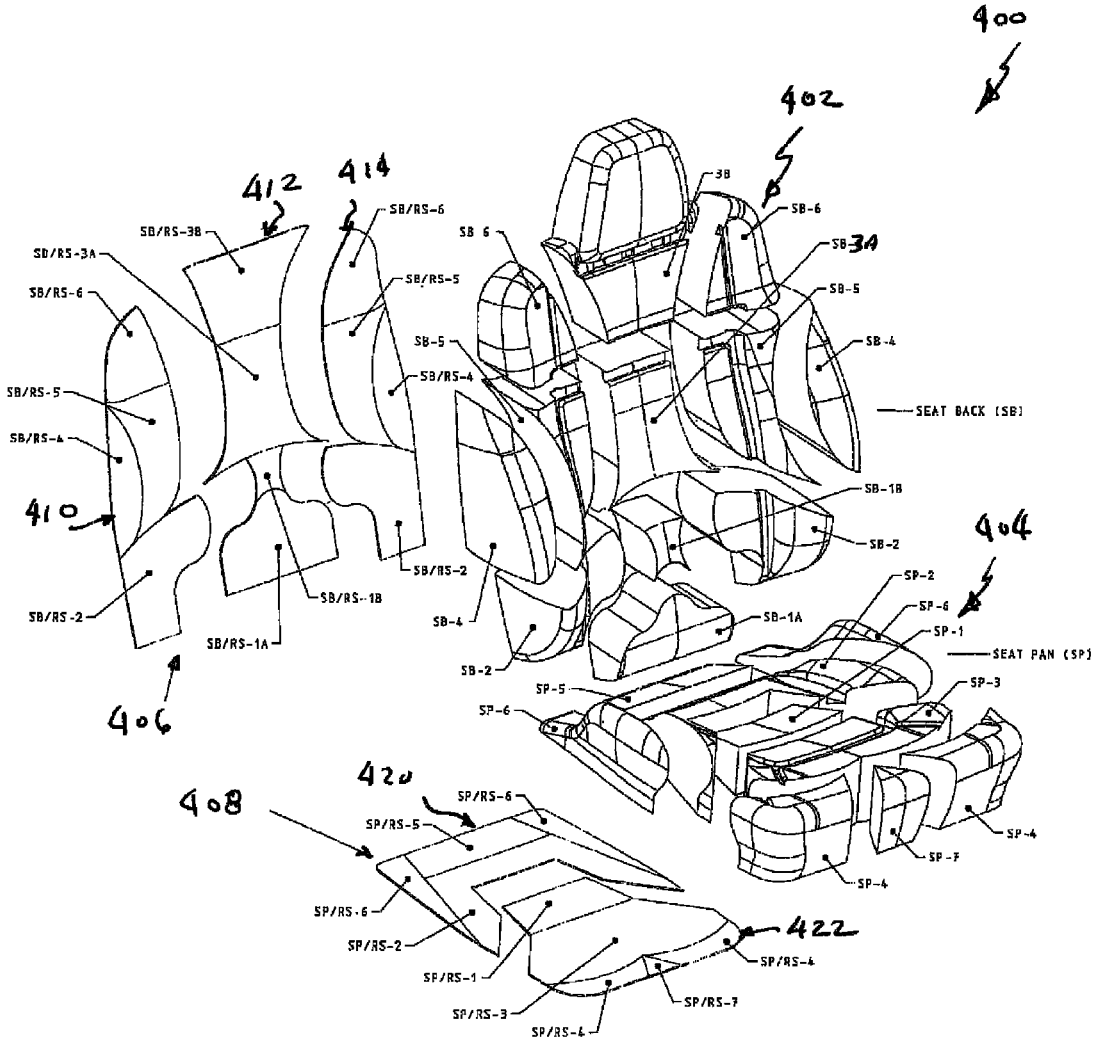
FIG. 4 is a perspective view another seat embodiment incorporating the multi-zoned supports shown in FIGS. 1 and 2 incorporating a zoned recoil shield in the seat back and seat pan.

FIG. 4 shows another molded seat embodiment that again uses the multi-zoned design described above in connection with FIGS. 1 and 2. Here seat 400 is comprised of a seat back 402 and a seat bottom or pan 404 and recoil shields 406 and 408 are also being used. The recoil shield 406 used with seat back 402 is now comprised of three vertically separated sections 410, 412 and 414, respectively. The recoil shield 408 used with the seat pan 404 is comprised of two sections 420 and 422, respectively, with section 420 being an aft section and 422 being a forward section.

Recoil shield 406 has a left section 410 that will work with zones SB-2, SB-4, SB-5 and SB-6 with shield piece 414 interacting with similar zones on the opposite side of the seat back. The central recoil shield section 412 is designed to interact with zones SB-1A, SB-1B, SB-3A and SB-3B.

The seat pan shield 408 has an aft or rear section 420 that will interact with zones SP-2, SP-5 and SP-6 while the front section 422 interacts with zones SP-1, SP-3, SP-4 and SP-7.

The seat 400 will exhibit more flexibility than will seat 300 since the recoil shields 406 and 407 are themselves in segments and will permit the zoned sections to be supported yet allowing flexibility between the groups of supported zones.

Figure 5:
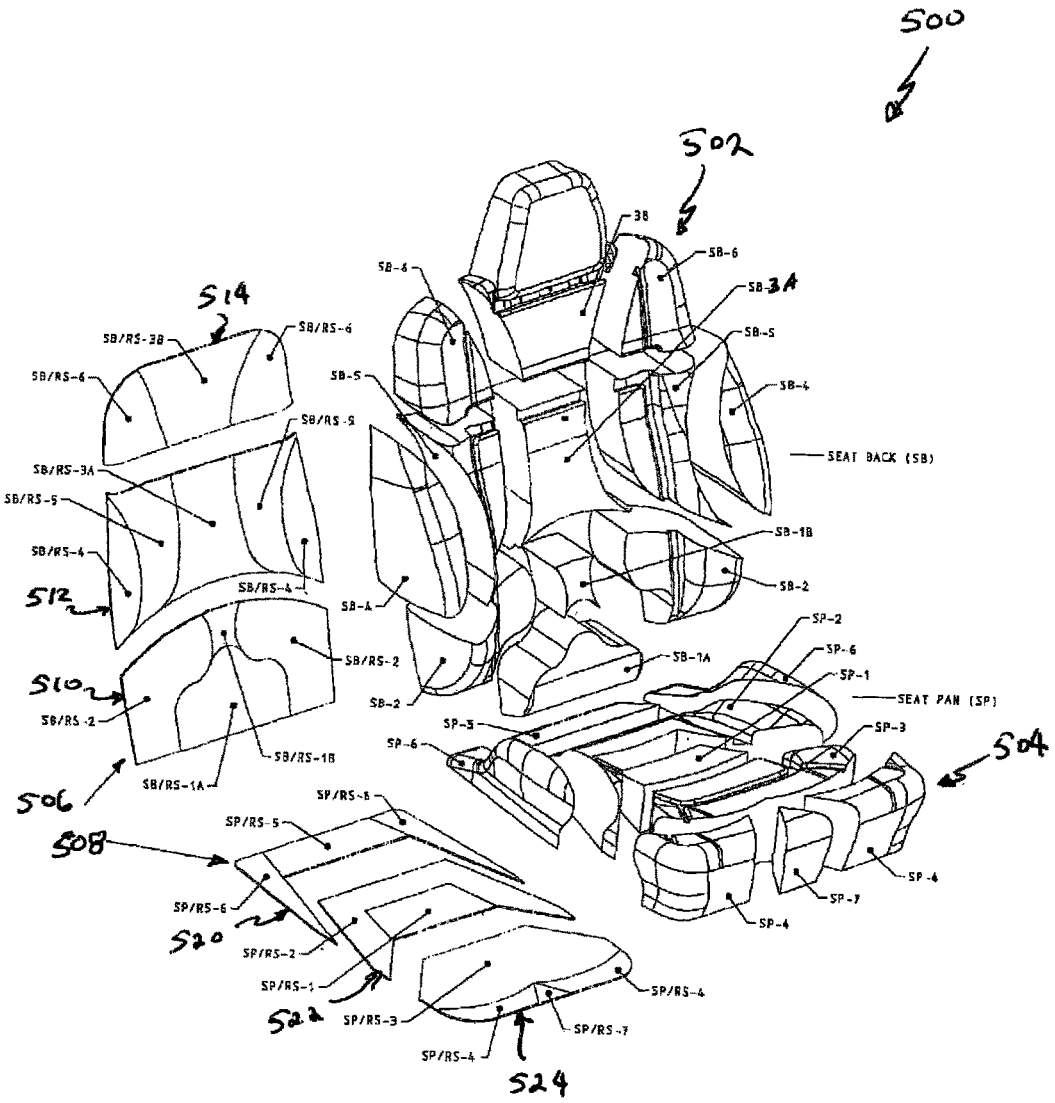
FIG. 5 is a perspective view of another seat embodiment incorporating the multi-zoned supports shown in FIGS. 1 and 2 and a zoned recoil shield in the seat back and seat pan.

FIG. 5 shows a seat 500 that continues to use the zoned approach described for FIGS. 1 and 2. Here the seat back 502 and seat pan 504 are formed from foam and in this embodiment a different form of recoil shields 506 and 508 are being used. Seat back shield 506 is comprised of three horizontally separated sections 510, 512 and 514. The seat pan shield 508 is also comprised of three sections that include an aft section 520, a middle section 522 and a forward section 524.

Seat back shield 506 has a bottom section 510 that is designed to interact with zones SB-2, SB-1A and SB-1B. The middle section 512 interacts with zones SB-4, SB-5 and SB-3A. The top section 514 interacts with zones SB-6 and SB-3B.

Seat pan shield 508 has an aft section that is designed to interact with zones SP-6 and SP-5. The middle section 522 interacts with zones SP-2 and SP-1. The forward section 524 interacts with zones SP-3, SP-4 and SP-7.

Seat 500 will also provide a more flexible structure than that of seat 300 as again the recoil shields 506 and 508 are themselves segmented and will allow more flexibility than a solid, one piece recoil shield as the supported zones will be able to more relative to one another. The flexibility will be different from that of seat 400 as the recoil shields are segmented differently and will produce a different collection of supported zones that can move along three horizontal lines rather than the vertical lines of seat 400.

Figure 6:
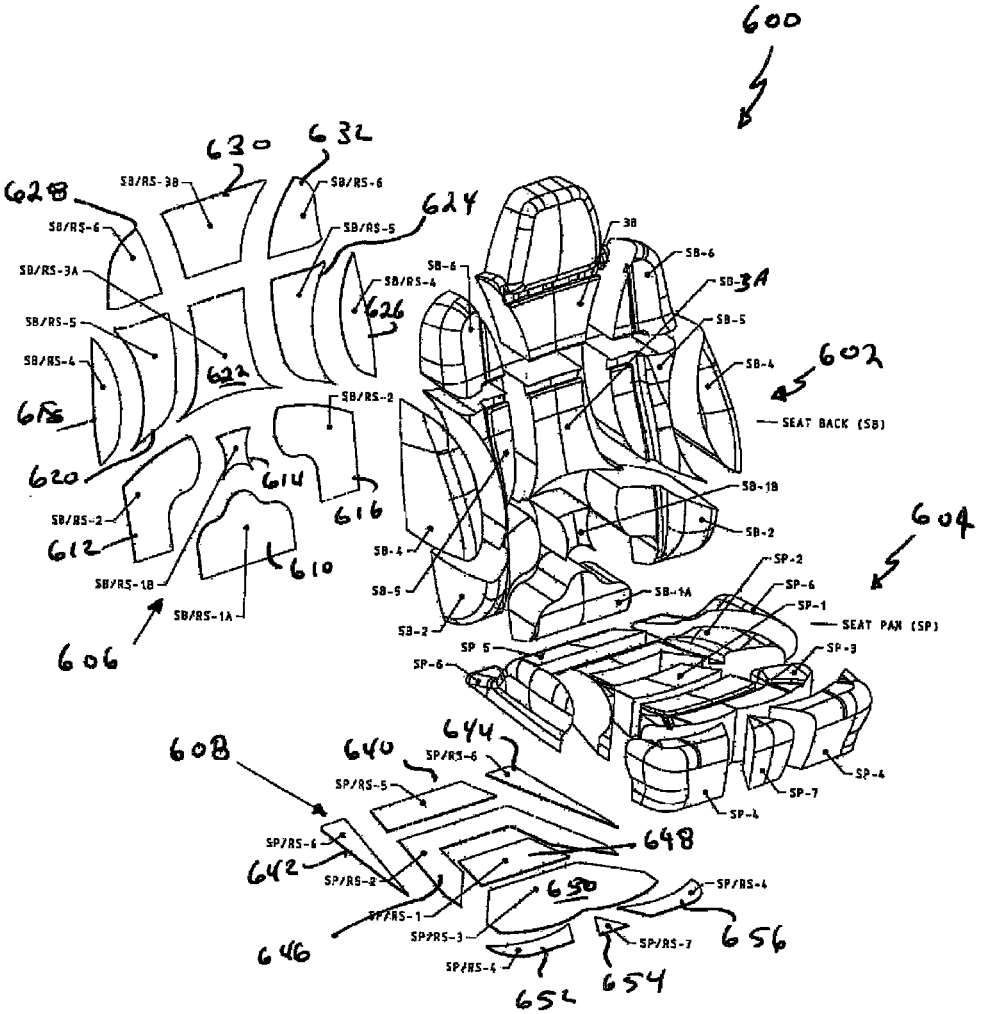
FIG. 6 is a perspective view of one seat embodiment incorporating the multi-zoned supports shown in FIGS. 1 and 2 and a different embodiment of a zoned recoil shield in the seat back and seat pan.

FIG. 6 shows a seat 600 as comprised of seat back 620 and as seat pan 604. Again two recoil shields are used, 606 with the seat back 602 and 608 with seat pan 604, respectively. Recoil shields 606 and 608 are very different from the previous recoil shields in that each is now segmented in a manner consistent with the zoned seat back and seat pan. For example, recoil shield 606 is comprised of sections 610-632 with each matching a respective zone in the seat back 602. The pairings are noted on FIG. 6.

Similarly, seat pan recoil shield 608 is comprised of sections 640-656 and these are also paired with the zones used in seat pan 604 as shown in FIG. 6.

In each case, the zoned section is supported by its own individual recoil shield and it will interact with the zone, the foam or the material from which the zoned part is constructed. Further, as was the case with recoil shields 160-166 in FIGS. 7*a* and 7*b*, each recoil shield shown in FIGS. 2-6 can be mounted to the rear of a zoned section for which it has been designed to interact, it can be incorporated within the molded zoned section or it need not be used at all so that only the zoned section will provide the support. In addition, combinations of the zoned sections with and without a recoil shield could also be used in forming a seat. For example, seat 600 could be formed using only the central recoil shields 630, 622, 614 and 610 in the seat back 602, or perhaps only the peripheral shield sections 628, 632, 618, 620, 624, 626, 612 and 616 might be used. This same selection can also be used with the shields shown in FIGS. 4 and 5 so that only some but not all of the recoil section being used in any given seat.

FIG. 7, FIG. 7*a* and FIG. 7*b* show a molded foam seat with sections 100-106 shown on the seat bottom 110 and zones 120-152 on the seat back 112. The zones shown here are modified from those described above in connection with FIGS. 1 and 2, but still include a plurality of individual zones designed to support specific structures within the human anatomy. Several of the seat back zones have been modified, for example, the two zones SB-6, and the central zone SB-3B have been redesigned into zones 150 and 152 with a central gap 154 there between. Gap 154 located in the center of seat back 112 extends vertically from the upper edge to the bottom of the seat back 112 as shown. Zone SB-3A has been separated and each half has been combined within zones 144, 146, 138 and 140 along with an interior portion of zones SB-5. Zones 142 and 148 are carved out of old zones SB-4 and a portion of SB-5. Zones 122 and 130 are also carved from portions of SB-4, SB-5 and SB-2. Zones 124 and 128 are carved from zones SB-2, SB-1A and SB-1B, while zones 120 and 132 are taken from portions of zones SB-4 and SB-2. At the front edge, SP-4 has been split into zones 100 and 102 on one side and zones 106 and 108 on the other.

Regardless of the zone changes, the human anatomy is being supported by individual zones designed to provide specific stabilizing support of specific portions of the anatomy and this translates into a nested and comfortable seat.

As shown in the cross sectional views of FIGS. 7*a* and 7*b* the individual zoned structures are interconnected by a webs 156 that are formed where the mold sections (not shown) do not meet within the mold. These webs 156 collectively form a tying structure that holds individual sections together until the seat back 112 or seat pan 110 are otherwise supported by a frame, by a trim package or seat cover or a combination of such structures. It should be understood that webs 156 can have varying dimensions. Where the foam used to make the zoned sections is soft the webs 156 would preferably have a greater thickness, and that thickness could vary from about 10% of the foam thickness to about 90% of foam thickness. Webs 156 can be used to control the amount of movement one zone has with adjacent zones with a thicker web limiting such movement while a thinner web thickness would permit that motion.

As was previously discussed, the molded structures can also include a recoil shield that could be mounted, attached or applied to the rear of the zoned sections as is shown by dotted line 160. The recoil shield 160 could itself be contoured, as is described for members 1002 and 1102 in FIG. 13 hereinafter, or they could be shaped to provide a level of resilience or spring back once installed and a user is in the set and placing forces thereon. Alternatively, the recoil shield could still be shaped or contoured as described above and then be integrally formed within the molded structure, such as by being over molded with foam or other material, as is shown in dotted line at 162.

FIG. 8 shows another embodiment of a molded multi-zoned seat 900 that is comprised of a seat back 902 and a seat pan 904. The seat back 902 includes zones 1A, 1B, 2B, 3A, 3B, 4B, 5B and 6B. Seat pan 904 includes zones 1P-6P. Seat back zones 1A through 6B also differ from those described in connection with FIGS. 1 and 2 and from FIG. 8. However, the individual zones used in seat 900 continue to support specific human anatomy structures and provide a unique solution to anatomy support. Zone 1A is similar to SB-1A but it has been divided into three sections. Zone 1B is smaller than SB-1B but continues to be located in the center of the seat back 902. Zone 3A has been formed from portions of SB-3A and the inner central portion of SB-5. Zone 4B derives from SB-4 and a portion of SB-6 while zone 5B comes from portions of SB-5 and SB-4. Across the top zones 6B and 3B come from zones SB-6 and SB-3B. These zones continue to support similar portions of the human anatomy but with a slightly different emphasis on where the support is focused.

In seat pan 904 the zones have again been divided slightly differently. For example, zone SP-5 has been divided into two sections 5P, the rear center of SP-2 has been made into two center zones 1P, the former side portions of SB-2 are now included in 2P which also includes the front portion of SB-6. Zones 6P are carved from the rear portion of zone SB-6 and SB-3 has been divided into two separate zones 3P. Zones SP-4 and SP-7 have been combined and then split in two forming a pair of front zones 4P. Here again, specific portions of the human anatomy continue to be individually supported by the new zoned sections and they form an environment where the anatomy is nested and comfortably supported while at the same time the anatomy and the interconnecting musculature, ligaments, joints and soft tissues are supported in a way that minimizes fatigue and which improves muscle function.

The foam used is preferably polyurethane foam which can have a density ranging from about 20 to about 60 Shore 000 durometer, and preferably from about 30 to about 40 Shore, or a density of about 1.5 pcf to about 5.0 pcf.

FIG. 8 also shows the presence of gaps 910 between adjacent zones and these are formed by the portions of the mold itself where internal walls separate one zone from another within the mold.

FIGS. 9 and 10 show another embodiment of a multi-zoned seat with FIG. 9 showing a plan view of a seat pan 1002 and FIG. 10 showing a seat back 1102.

Seat pan 1002 includes zones 1-20 while seat back 1102 includes zoned sections 21-44.

As described herein, the subject matter of this application is the comfortable support of the human anatomy in a wide range of support positions and conditions. Current approaches have been less than successful in achieving this goal of comfort, let along combining comfort along with a way to strengthen the body's ability to perform or relax. This support approach begins by segregating the body into independently functioning bio-mechanical zones. Then by using an independent zoned support approach matched to the segregated, bio-mechanical zones creates the opportunity to manage the support of the human anatomy by the micro-management of its parts. Each zone has been established to not only work and function independently, but to carry out its particular support activity within that zone and to, on occasion, to influence other zones. By micro-managing the performance, fit and loading within a zone, this support approach provides a solution for the body's response to counterbalance muscular-skeletal forces in a number of axes and to provide, therefore, anatomical compensation. As a part of the desired micro-management of the anatomy, each zone can selectively pair the appropriate amount of load and directional force to the zone's anatomical design and load capacity. Thus, the amount of weight, mass, shape, size and surface deflection provided by each zone, as it is moved or oriented relative to a base plane and to other adjacent zones; collectively the zones will produce a support uniquely keyed to the $95^{th}$ percentile of human anatomy shapes and sizes. It should also be understood that joints and structures of the human anatomy were designed differently in order to provide specialized performance. All joints and structures cannot and should not be expected to share equal loads and/or directional forces, not were they designed that way. Consequently, the multi-zones approach provides a method to appropriately receive and support a designated load and to define and provide a designated anatomical load. As a result, this multi-zones support approach does not over load joints or other anatomical structures, but instead collectively manages the loading thereon by apportioning the proper amount of load and directional forces per zone. This reduces the risk of fatigue, injury and/or discomfort and yields a comfortable support regardless of position.

The multi-zoned approach applies primary support to the centerline of human anatomy and then spreads outwardly therefrom without inducing discomfort. The result of beginning with centerline support provides a new method to manage muscle balance of muscles that are antagonistic and synergistic and a way to manage load limits between joints, ligaments, tendons and muscles. The result of this load management provides comfort, endurance, strength and improved human performance. Moving out from the centerline base secondary support is then provided by forty four independent zones to accomplish this support objective. By independently managing multiple zones of anatomical support the support approach described herein proportionally allocates comfort, load and fit for the majority of human beings in any postural position and this play a role as well in achieving the comfort sought and in managing strength and performance. Further, by controlling or micro-managing loads between groups of muscles, ligaments, tendons and joints and soft tissues and other opposing structures of the human anatomy also manages stresses between skeletal structures and further adds to the comfort felt by a supported individual, whether seated upright, partially or fully reclined or in a supine position.

Seating can be best understood and described by looking at both the seat pan or bottom and the seat back as separate parts of the total seat. The Seat Pan, as shown in FIG. 9, has been divided into a number of independent zones designed to support discrete parts of the human anatomy and include the following:

| Seat Pan Zones | Supported Anatomical Part |
|---|---|
| 12 and 13 | Ischial Tuberosities, Sacrum Apex |
| 11, 6, 14 and 9 | Posterior to medial support of the gluteus region, the Hip Joints/Acetabulum, the Sacrum, the medial to lateral aspect of the mid-thigh |
| 7 and 8 | Femurs 1, 2, 3 and 4 Distal Femurs and lateral support of the distal end of femurs and thigh |
| 17 and 18 | Posterior to medial portion of Pelvis (Posterior Gluteal Region) |
| 15, 16, 5, 19, 20 and 10 | Posterior to medial-lateral and lateral aspect of ilia; Hip Joints/Acetabular Complex Proximal Femur |
| 2 and 3 (central portion of each) | Medial Femur<br>Outer perimeter (un-bolstered) Anatomical Perimeter Outwardly most region of anatomical contact with Seat Pan's Perimeter |

The seat back as shown in FIG. 10, in a like manner, has been divided into a number of independent zones designed to support portions of a seated user's back as follows:

| Seatback Zone | Anatomical Part |
|---|---|
| 23, 24, 25 | Sacrum Area and ilia |
| 29 | Lumbar Vertebra Complex<br>Soft Tissues of the Lumbar Vertebral Complex and adjacent inter-related muscular skeletal joints and tissues |
| 21, 22, 26, 27 28, 30 | Ilia and lower one third of torso; inferior and inferior-lateral aspect of torso; Ilia and Soft Tissues of the ilium and adjacent inter-related muscular skeletal joints and tissues and para-spinal support |
| 33, 34, 35 | Thoracic (12 Vertebra of the spine) & Thoracic- Lumbar Spine Transition (2-6), as well as the Thoracic & Thoracic-Lumbar Transitional complex and soft tissues of the adjacent inter-related muscular skeletal joints and tissues |
| 40, 41, 42 | Superior-posterior and posterior-lateral aspect of upper torso; Upper Thoracic & Cervical Thoracic or occipital Transitional complexes and soft tissues of the adjacent inter-related muscular skeletal joints and tissues |
| 31, 37 | Lateral aspects of the Mid-torso including the Ribs (12 Ribs), the Thoracic Skeleton and the soft tissues of the adjacent inter-related muscular skeletal joints and tissues |
| 32, 36 | Mid-torso; Superior & Inferior Scapulae Posterior to posterial -lateral Rib Cage, the Superior Ilia, Mid-Superior Medial Thoracis Skeleton, the Superior & Inferior Scapulae, Medial Rib Cage, Superior Ilia, & Mid-Superior Medial Thoracic Skeleton and the soft tissues of the adjacent inter-related muscular skeletal joints and tissues |
| 38, 39, 43, 44 | Superior-posterior and posterior-lateral aspect of upper torso; Shoulder, Superior Scapulae; Upper Thoracic Shoulder, Superior Scapulae, Upper Thoracic and Cervical-Occipital transition and the soft tissue of the adjacent inter-related muscular skeletal joints and tissues and the lateral aspects of the inferior, mid and superior torso. |

Zones 1-44 comprise a plurality of individual, anatomically designed structures each of which exhibits a specific shape as shown in FIGS. 9 and 10. These zoned structures have been designed to provide support for particular anatomical structures, as noted just above in the tabular listing, as well as a superior way to fit an individual to a seat in a way that supports and nests the human anatomy in a manner that improves fit, performance, allows endurance and at the same time produces a comfort level that current seating cannot deliver. With a person sitting on a seat formed from zones 1-44, each of the individual zone structures or elements 1-44 can be moved toward and/or away from a reference point to intersect the chosen part of the anatomy of the seated person for which a zoned structure is deigned to provide support. When so moved, and the person then leaves the seat, these zoned structures 1044 collectively create and define a contoured surface, like that shown in FIG. 12. The positions of each zoned structure and their individual surfaces that collectively form the whole contoured surface for each of the seat back, for example 1100 in FIGS. 11 and 12 and seat pan 1000, can than be identified or the surface itself defined, for example, by mechanically sensing the location of the zoned structures and their surfaces, by optically scanning the resulting collective surface, or by reference to the movement relative to the reference point. This identification and/or defining process will produce data corresponding to the collective contoured surface and that data can be stored for later use. Once identified or defined that contoured surface can then be recreated from the stored data corresponding to the contoured surface into, for example, a molded or otherwise shaped seat pan piece, as is shown at 1002 in FIGS. 11*a*-11*c* and 13 and a molded or otherwise shaped seat back piece as shown at 1102 in FIGS. 11*a*-11*c* and 13. That contoured surface data could also be used to directly shape a mold from which parts can be made, used to shape a number of different materials from plastic, to composites, to metal, wood, reinforced materials or composites, or to shape a recoil shield for use with the seat structures.

FIG. 11 shows a front elevational view of a seat with seat back 1100 and seat pan 1000 wherein the zoned sections have been moved or adjusted. Three cross sectional views are shown in FIGS. 11*a*-11*c* which have been taken along lines A-A, B-B, and C-C, respectively. In FIG. 11*a*, which runs down the center line of the seat, the zoned structures in the seat back, namely 41, 34, 29 and 24, are shown in a moved condition. Likewise, in the seat pan 1000, zoned structures 2, 7, 12 and 17 are also shown in a moved condition. As a consequence, their upper surfaces collectively define a contoured shape that runs or extends along that cross section line. When looking at the whole seat surface, as is shown in FIG. 12 data from the collective contoured surface can be used, as explained above, to form a contoured member and such a member is shown by the pieces 1102 and 1002 in FIG. 11*a* and FIG. 13. Each of these pieces, 1002 and 1102, correspond to a molded or shaped structure which exhibits the contoured shape created by having moved the individual zoned sections 1-44. FIGS. 11*b* and 11*c* show similar view of the zoned structures, their moved positions and the shape of a resulting molded piece along that cross sectional line.

The molded or otherwise shaped pieces 1102 and 1002 can then be used in one of several ways. First, they could be used by themselves as the seat. For example, the two pieces could be formed together and when legs or some other supporting mechanism is added a contoured seat results. Secondly, for example, as shown in FIG. 13, they could be used to produce a seat 1200 comprised of a seat back 1202 and a seat pan 1204. At the core of seat back is the molded contoured piece 1102 with, for example, a one inch thick piece of foam 1206 having a Shore 000 durometer rating of about 40-60, or a density of about 1.5 pcf to about 5.0 pcf, and preferably from about 1.8 pcf to about 3.0 pcf, placed thereon. As a specific example of foams, polyurethane foams with a code or designation of "28035", "28045" and "28060" can be used in thicknesses ranging from about 1 inch to about 4 inches. The "280" portion of the designation refers to the density, and means 2.8 pcf. The last two numbers, for example "35" refers to the ILD rating of that foam, and ILD values can vary from about 20 to about 100.

The foam 1206 can be adhered to the molded piece 1102, in whole or in selected places, or it can simply be placed thereon. A trim package 1208, in the form of a leather or cloth seat cover, can then be positioned over both the molded piece 1102 and the foam 1206 to thereby hold these individual pieces together. It is also possible to have a frame or a support structure 1214 to which the molded piece 1102, the foam 1206 and the trim package 1208 can be mounted, preferably by the trim package 1208 although it should be understood that other techniques known in the art could be used to mount the molded piece and the other seat parts to such a frame or support.

The seat pan 1204 can be constructed in a similar manner by having a one inch foam piece 1210, which can also have a Shore 000 durometer rating of about 30-60, or a density of about 1.8 pcf to about 3.0 pcf, placed over the molded piece 1002. A trim package 1212 can then be used, along with, for example a frame or support structure 1216, and here again the trim package 1212 can be used to hold the molded structure 1002, the foam 1210 onto the frame 1216.

With the trim packages 1208 and 1212 in place, seat 1200 will have a seat pan 1204 and a seat back 1202 that replicate the contoured surface initially formed by the adjustment of the zoned structures 1-44 as shown in FIGS. 9, 10 and 12. The resulting seat 1200 will exhibit the same nesting of anatomical structures and a comfort level as was established from the adjusted zoned structures 1-44. In addition, such a seat can be altered or modified, for example, to fit a particular individual, by going back to the zoned structures 1-44 and readjusting them for a new individual or for a different anatomy. Further, an average of many sets of data corresponding to a variety of different adjusted settings for the zones structures 1-44 can be used to fit a wider segment of the population or of a particular segment of such a population who might have particular needs due to their particular anatomies.

It should also be understood that frames 1214 and 1216 could also be an existing seat structure with the other components in seat 1200, the molded or shaped pieces 1002 and 1102, the foam layers 1206 and 1210, and the trim package 1208 and 1212, collectively thereby being essentially an overlay on an existing seat structure.

The molded pieces 1002 and 1102 could also be used as an insert that could be fit into an otherwise molded structure to provide a contoured result for a seated occupant. The pieces could also be used as the recoil shield or used with a separate recoil shield to thereby expand the support objectives and to enable use of a wide range of materials not previously considered for seating purposes. Further, pieces 1002 and or 1102 could be placed in a mold and then over molded so that the pieces would be integrally formed with foam or other moldable or shapeable material.

In addition, the data from the identification of the contoured surface of the moved zoned structures can be used to form a contoured surface directly from foam, similar to the seats shown in FIGS. 7-8, or from other materials including metal, wood, hard plastics, composites, varying types of flexible, semi-rigid and rigid foams, and combinations of such materials. It should be understood that such materials can be solid structures, but relatively thin, yet strong enough to be used by themselves as the seat, or they can be structures that are perforated, a screen type of material, be provided with openings that will assist in the molding or shaping thereof or that could provide a level of resiliency or spring back upon the application of forces thereon. This description of materials, their types, structure and composition is meant to be only exemplary and not restrictive, and is therefore only suggestive of materials and their construction. The contoured pieces could also be sandwiched or paired with a variety of materials, from fabrics, thin sheets, plastic or composite sheets or layers, molded pieces or other elements which can themselves be shape modified by their being paired with such contoured pieces that have been molded or shaped according to the disclosures herein.

Further, it is also possible to form an inexpensive zoned seat by incorporating one of the zoned design embodiments disclosed herein by employing a sewn trim package together with a suitable foam layer and to have sew lines within the trim package follow along the zoned sections thereby replicating the multi-zoned approach disclosed. Such a resulting structure could be used by itself, it could be used on an existing seat, it could be combined with a recoil shield or with a molded or shaped member that would also replicate the surface resulting from zoned section movements as demonstrated in FIG. 12.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed:

1. A contoured seat, comprising: a seatback and a seat pan connected to the seatback, the seatback having anatomical supports for a seated user; said anatomical supports comprising:

a seatback sacral support having a top portion and a bottom portion narrower than the top portion the sacral support being configured to isolate the sacral region from other anatomical regions of the seated user's spine, and a seatback lumbar vertebra complex support configured to isolate the lumbar vertebra complex region from other anatomical regions of the seated user's spine, wherein the seatback lumbar vertebra complex support has a top portion having a first width, a bottom portion having a second width and an intermediate portion connecting the top portion and the bottom portion, the intermediate portion smaller than the first width and the second width.

2. A contoured seat according to claim 1, wherein the seat pan has anatomical region supports for each of the seated user's posterior pelvic regions, ischial tuberosities regions, and femur regions; said seat pan supports comprising: a seat pan posterior pelvic support configured to isolate the posterior pelvic region from other seat pan anatomical regions of the seated user; a seat pan ischial tuberosities support to isolate the ischial tuberosities from other seat pan anatomical regions of the seated user, and a seat pan femur support to isolate the femurs from other seat pan anatomical regions of the seated user.

3. The contoured seat according to claim 2, wherein each seat pan support is adjustable.

4. The contoured seat according to claim 3, wherein each seat pan support is adjustable toward and away from the seated user.

5. The contoured seat according to claim 2, wherein the seat pan ischial tuberosities support has a substantially trapezoidal support surface.

6. The contoured seat according to claim 2, wherein the seat pan femur support has a first portion located proximate to the seat pan ischial tuberosities support and a second portion located proximate to the perimeter of the seat pan, the first portion being substantially narrower than the second portion.

7. The contoured seat according to claim 6, wherein the seatback sacral support is adjustable.

8. The contoured seat according to claim 7, wherein the seatback sacral support is adjustable toward and away from the seated user.

9. The contoured seat according to claim 7, wherein the seatback thoracic support is adjustable.

10. The contoured seat according to claim 9, wherein the seatback thoracic support is adjustable toward and away from the seated user.

11. The contoured seat according to claim 9, wherein said anatomical supports further comprise a seatback ilium and para-vertebral support configured to isolate the ilium and para-vertebral region from other anatomical regions of the seated user's spine.

12. The contoured seat according to claim 11, wherein said anatomical supports further comprise and a seatback scapular support configured to isolate the scapular region from other anatomical regions of the seated user's spine.

13. The contoured seat of claim 12, wherein the seatback scapular support has an upper section and a lower section, the lower section being substantially narrower than the upper section.

14. The contoured seat of claim 11, wherein the seatback ilium and para-vertebral support has a section having a first thickness, and a section having second thickness larger than the first thickness.

15. The contoured seat according to claim 9, wherein said anatomical supports further comprise and a seatback scapular support configured to isolate the scapular region from other anatomical regions of the seated user's spine.

16. The contoured seat according to claim 15, wherein the seatback scapular support has an upper section and a lower section, the lower section being substantially narrower than the upper section.

17. The contoured seat of claim 2, further comprising a seatback ilium and paravertebral support configured to isolate the ilium and para-vertebral region from other anatomical regions of the seated user's spine, a seatback thoracic support configured to isolate the thoracic region from other anatomical regions of the seated user's spine, and a seatback scapular support configured to isolate the scapular region from other anatomical regions of the seated user's spine.

18. The contoured seat according to claim 1, wherein the seatback sacral support is adjustable.

19. The contoured seat according to claim 18, wherein the seatback sacral support is adjustable toward and away from the seated user.

20. The contoured seat according to claim 18, wherein the seatback lumbar vertebra complex support is adjustable.

21. The contoured seat according to claim 20, wherein the seatback lumbar vertebra complex support is adjustable toward and away from the seated user.

22. The contoured seat according to claim 20, wherein said anatomical supports further comprise a seatback ilium and para-vertebral support configured to isolate the ilium and paravertebral region from other anatomical regions of the seated user's spine.

23. The contoured seat according to claim 22, wherein said anatomical supports further comprise and a seatback scapular support configured to isolate the scapular region from other anatomical regions of the seated user's spine.

24. The contoured seat according to claim 23, wherein the seatback scapular support has an upper section and a lower section, the lower section being substantially narrower than the upper section.

25. The contoured seat according to claim 22, wherein the seatback ilium and paravertebral support has a section having a first thickness, and a section having second thickness larger than the first thickness.

26. The contoured seat according to claim 20, wherein said anatomical supports further comprise and a seatback scapular support configured to isolate the scapular region from other anatomical regions of the seated user's spine.

27. The contoured seat according to claim 26, wherein the seatback scapular support has an upper section and a lower section, the lower section being substantially narrower than the upper section.

28. A contoured seat, comprising: a seatback and a seat pan connected to the seatback, the seatback having anatomical supports for a seated user; said anatomical supports comprising: a seatback sacral support having a top portion and a bottom portion, said bottom portion narrower than the top portion, the sacral support being configured to isolate the sacral region from other anatomical regions of the seated user's spine, and a seatback thoracic support configured to isolate the thoracic region from other anatomical regions of the seated user's spine;

wherein the seatback thoracic support has an upper section and a lower section, the upper section being substantially narrower than the lower section.

29. A contoured seat according to claim 28, wherein the seat pan has anatomical region supports for each of the seated user's posterior pelvic regions, ischial tuberosities regions, and femur regions; said seat pan supports comprising: a seat pan posterior pelvic support configured to isolate the posterior pelvic region from other seat pan anatomical regions of the seated user; a seat pan ischial tuberosities support to isolate the ischial tuberosities from other seat pan anatomical regions of the seated user, and a seat pan femur support to isolate the femurs from other seat pan anatomical regions of the seated user, each seat pan support being adjustable toward and away from the seated user.

30. The contoured seat according to claim 29, wherein each seat pan support is adjustable.

31. The contoured seat according to claim 30, wherein each seat pan support is adjustable toward and away from the seated user.

32. The contoured seat of claim 29, wherein the seat pan ischial tuberosities support has a substantially trapezoidal support surface.

33. The contoured seat of claim 29, wherein the seat pan femur support has a first portion located proximate to the seat pan ischial tuberosities support and a second portion located proximate to the perimeter of the seat pan, the first portion being substantially narrower than the second portion.

* * * * *